US007866120B2

(12) United States Patent
Prenn

(10) Patent No.: US 7,866,120 B2
(45) Date of Patent: Jan. 11, 2011

(54) POST WRAP DEVICE

(76) Inventor: Joseph Prenn, 4234 Mount Voss Dr., San Diego, CA (US) 92117

( * ) Notice: Subject to any disclaimer, the term of this patent is extended or adjusted under 35 U.S.C. 154(b) by 0 days.

(21) Appl. No.: 12/179,401

(22) Filed: Jul. 24, 2008

(65) Prior Publication Data

US 2009/0025336 A1 Jan. 29, 2009

Related U.S. Application Data

(63) Continuation of application No. PCT/US2007/002239, filed on Jan. 24, 2007, which is a continuation-in-part of application No. 11/339,986, filed on Jan. 25, 2006.

(51) Int. Cl.
*E04C 3/00* (2006.01)

(52) U.S. Cl. ..... 52/835; 52/844; 52/836; 52/288.1; 52/169.13

(58) Field of Classification Search ..... 52/40, 52/170, 834, 835, 844, 843, 836, 169.13, 52/218, 219, 287.1, 288.1, 290
See application file for complete search history.

(56) References Cited

U.S. PATENT DOCUMENTS 1,250,594 A * 12/1917 Knapp ..... 52/288.1
1,756,023 A * 4/1930 Felsenthal ..... 138/156
1,842,308 A * 1/1932 Bohnsack ..... 52/844
1,883,214 A * 10/1932 Wilson ..... 428/33
1,917,365 A * 7/1933 Goertz et al. ..... 52/282.3
3,199,258 A 8/1965 Jentoft et al.
3,355,852 A * 12/1967 Lally ..... 52/834
3,707,061 A * 12/1972 Collette et al. ..... 52/288.1
4,034,535 A * 7/1977 Dustmann ..... 52/834
4,084,360 A 4/1978 Reckson
4,150,517 A 4/1979 Warner, Sr.
4,467,584 A 8/1984 Crites et al.
4,484,427 A * 11/1984 Crites et al. ..... 52/261
4,621,471 A * 11/1986 Kuhr et al. ..... 52/288.1
4,843,783 A * 7/1989 Taravella ..... 52/98
4,918,765 A * 4/1990 Harding ..... 4/460
4,934,114 A * 6/1990 Lindsey ..... 52/40
5,335,471 A 8/1994 Kupiec
5,622,356 A * 4/1997 Duggan ..... 256/1
5,832,675 A 11/1998 Zuares (Continued)

OTHER PUBLICATIONS

U.S. Office Action cited in related U.S. Appl. No. 11/339,986, filed May 1, 2009.

(Continued)

*Primary Examiner*—Robert J Canfield
*Assistant Examiner*—Babajide Demuren
(74) *Attorney, Agent, or Firm*—Knobbe Martens Olson & Bear LLP

(57) ABSTRACT

Embodiments are described of devices for concealing and/or protecting a portion of a member, such as the base of a post, which devices can be easily applied to the member at any time. These embodiments include a plurality of components adjustably connected to one another so as to provide a snug fit of the device against the member to be protected, regardless of initial variations from the expected dimensions of the member. Further device embodiments are self-adjusting to provide a snug fit regardless of subsequent changes in the dimension of the member over time.

27 Claims, 24 Drawing Sheets

U.S. PATENT DOCUMENTS 5,901,525 A * 5/1999 Doeringer et al. ..... 52/835
5,921,056 A * 7/1999 Weiss et al. ..... 52/745.16
5,924,259 A * 7/1999 Marousek ..... 52/656.1
5,956,920 A * 9/1999 Davis ..... 52/844
5,974,744 A * 11/1999 Guilbeault ..... 52/170
6,009,683 A 1/2000 Grewe et al.
6,148,566 A 11/2000 Giszpenc et al.
6,295,783 B1 * 10/2001 Davis ..... 52/834
6,412,250 B2 * 7/2002 Davis ..... 52/834
6,519,906 B2 2/2003 Yost et al.
6,712,546 B1 * 3/2004 Radu et al. ..... 404/8
6,795,986 B2 * 9/2004 Marbach et al. ..... 4/506
6,826,880 B2 12/2004 Yost et al.
D521,656 S * 5/2006 Terrels ..... D25/122
7,104,525 B2 9/2006 Ricci
7,146,774 B2 * 12/2006 Fredette ..... 52/656.6
7,243,473 B2 7/2007 Terrels
7,278,240 B2 10/2007 Burkart et al.
2002/0017072 A1 2/2002 Davis
2003/0051416 A1 * 3/2003 Inzeo ..... 52/40
2004/0206028 A1 * 10/2004 Terrels et al. ..... 52/287.1
2004/0221541 A1 * 11/2004 Fredette ..... 52/716.1
2005/0160697 A1 * 7/2005 Oliphant et al. ..... 52/731.4
2005/0229531 A1 10/2005 Green et al.
2006/0010824 A1 1/2006 Waters et al.
2006/0117704 A1 * 6/2006 Yoon et al. ..... 52/737.4
2006/0185270 A1 * 8/2006 Handley et al. ..... 52/169.14
2007/0119107 A1 * 5/2007 Shaw et al. ..... 52/287.1
2007/0163187 A1 * 7/2007 Price ..... 52/169.12

OTHER PUBLICATIONS

Office Action cited in U.S. Appl. No. 11/339,986 mailed Aug. 21, 2008.
Office Action cited in U.S. Appl. No. 11/339,986 dated Oct. 29, 2009.

* cited by examiner

POST WRAP DEVICE

RELATED APPLICATIONS

This application is a continuation of PCT Application No. PCT/US2007/002239, filed Jan. 24, 2007 and now published as WO 2007/087437, which is continuation-in-part of U.S. application Ser. No. 11/339,986, filed Jan. 25, 2006, now published as U.S. Pub. No 2007/0193203, each of which are hereby incorporated by reference.

FIELD OF THE INVENTION

This invention is directed to an apparatus for concealing and/or protecting a portion of a support member, such as the base of a post.

DESCRIPTION OF THE RELATED ART

Various types of devices have been developed in attempts to conceal and/or protect the bases of posts. Many of these devices comprise a monolithic sleeve which can be slid over the top of a post and brought down to cover the base of the post. Other devices comprise two portions which can be brought in contact with one another to surround the portion of the post to be concealed.

In many applications, particularly in the construction industry, it is desirable to provide an apparatus which is capable of covering the base of a post. In certain embodiments, such coverage is primarily an aesthetic feature, but in other embodiments, such coverage may provide protection to the base of the post and any associated components, as well as protection to persons who otherwise may be injured by contact with the covered elements, such as bolts and brackets. A post such as one used, for example, in the construction of a deck, is often secured to a slab or footing through the use of a large post bracket. An exposed post bracket may be both a safety hazard, as well as aesthetically unappealing, particularly when other protective materials, such as sealants, have been applied at the base of the post. In order to conceal such post brackets and other fixtures, a structure may be provided which covers the base of the post, enclosing the post bracket or other components of the post. In addition to the safety and aesthetic benefits of such a structure, these devices can also be used to protect the base of the post, such as by preventing water from pooling at the base of the post.

As discussed above, in certain existing art devices, the protective structure takes the form of a sleeve, which is slid over the top of the post once the base of the post has been fixed in place, but must be applied prior to securing anything to the top of the post, such as components of a deck to be supported. The timing of such application may be inconvenient, however, as the use of such a device requires the protective device to be applied essentially prior to the use of the post as a support. In addition, if such a device is damaged, or if one desires to remove or replace the device for any other reason, such removal would be extremely inconvenient, and replacement may not be possible.

Other existing devices are formed from two separate components, which can be brought together to form a protective structure. While these devices can be applied at any point in the construction process, and thus address one of the problems with the monolithic sleeve devices, they share other drawbacks with those devices. Of particular concern is their lack of adjustability to variances in post dimensions. Previously available devices have been sized to fit a particular post dimension. However, posts utilized in the construction industry, particularly timber posts, have a substantial amount of variance in their actual dimensions.

In addition to variance which exists at the time of cutting the wood post, the dimensions of the post may vary throughout the life of the post in response to absorbtion or evaporation of moisture. Such two-part devices cannot easily take into account such variances in post dimension, and the resulting structure is likely to either be too small for the post, resulting in stress and potential damage to the device upon device installation, or too large for the post, resulting in an undesirably large gap between the post and the edges of the protective device. These variations in size can hinder the usefulness of the structure as a protective device, in addition to being aesthetically unappealing.

To some extent, these issues can be addressed if protective structures are constructed on-site for each post base, taking into account the current dimensions of the post. However, production of such custom protective structures requires a considerable amount of work and expense on the part of the tradesmen working on-site, and do not fully address the potential variance in the dimensions of the post over the lifetime of the device.

SUMMARY OF THE INVENTION

In one embodiment, an apparatus is provided for enclosing a portion of a member, including a plurality of corner components, each of the plurality of corner components configured to contact a different portion of the member, and each of the plurality of corner components configured to adjustably and mechanically be connected to another of the corner components such that the corner components are adjustable with respect to one another so as to be secured against the member.

In another embodiment, an apparatus is provided for enclosing a portion of a member, the apparatus including a plurality of components, and the components cooperating to define a perimeter, wherein the components are configured to mechanically be connected to one another and are adjustable to vary the size of the perimeter to enclose a portion of the member.

In another embodiment, a method for enclosing a portion of a member is provided, the method including adjustably connecting a plurality of components to one another about the surface of a member so as to define a perimeter, said perimeter coinciding with the dimensions of the member.

In yet another embodiment, an apparatus for enclosing a portion of a member is provided, the apparatus comprising means for enclosing a portion of a member, means for retaining the enclosing means against the surface of the member, and means for adjustably connecting said enclosing means.

DETAILED DESCRIPTION OF THE PREFERRED EMBODIMENT

In contrast to existing devices, embodiments of the present invention provide a multi-component protective post wrap apparatus which can be applied at any time during in the construction process and which can readily adjust to variances in both the initial dimensions of a post and any variance which may result over time. In addition, due to the adjustability of these devices, the necessary components may be manufactured in large quantities, reducing the cost of the apparatus. The post wrap apparatus may alternately be referred to as a skirt, an apron, or a shroud. Generally, embodiments of the post wrap apparatus described herein serve to circumscribe the extremity of a member, and may serve to protect, embellish or conceal the termination and/or connection of interconnecting frame components or members.

For convenience, the terms post and base are used throughout this application, but it will be understood that embodiments of the present invention may be applied at any point where a member meets another surface, in order to cover the portion of the member proximate the surface. For instance, if desired, the protective structures described herein may be applied at the end of a beam which intersects a wall, or at a point in a frame where one member intersects another member.

In a first embodiment, a post wrap apparatus includes a plurality of corner components and an equal number of intermediate components. The number of corner and intermediate components is dependent upon the cross-sectional shape of the post to be covered. In a typical embodiment, the post will be rectangular in cross-section, and the post wrap apparatus will include four corner components and four intermediate components. An example of such an embodiment is depicted in FIG. 1.

Figure 1:
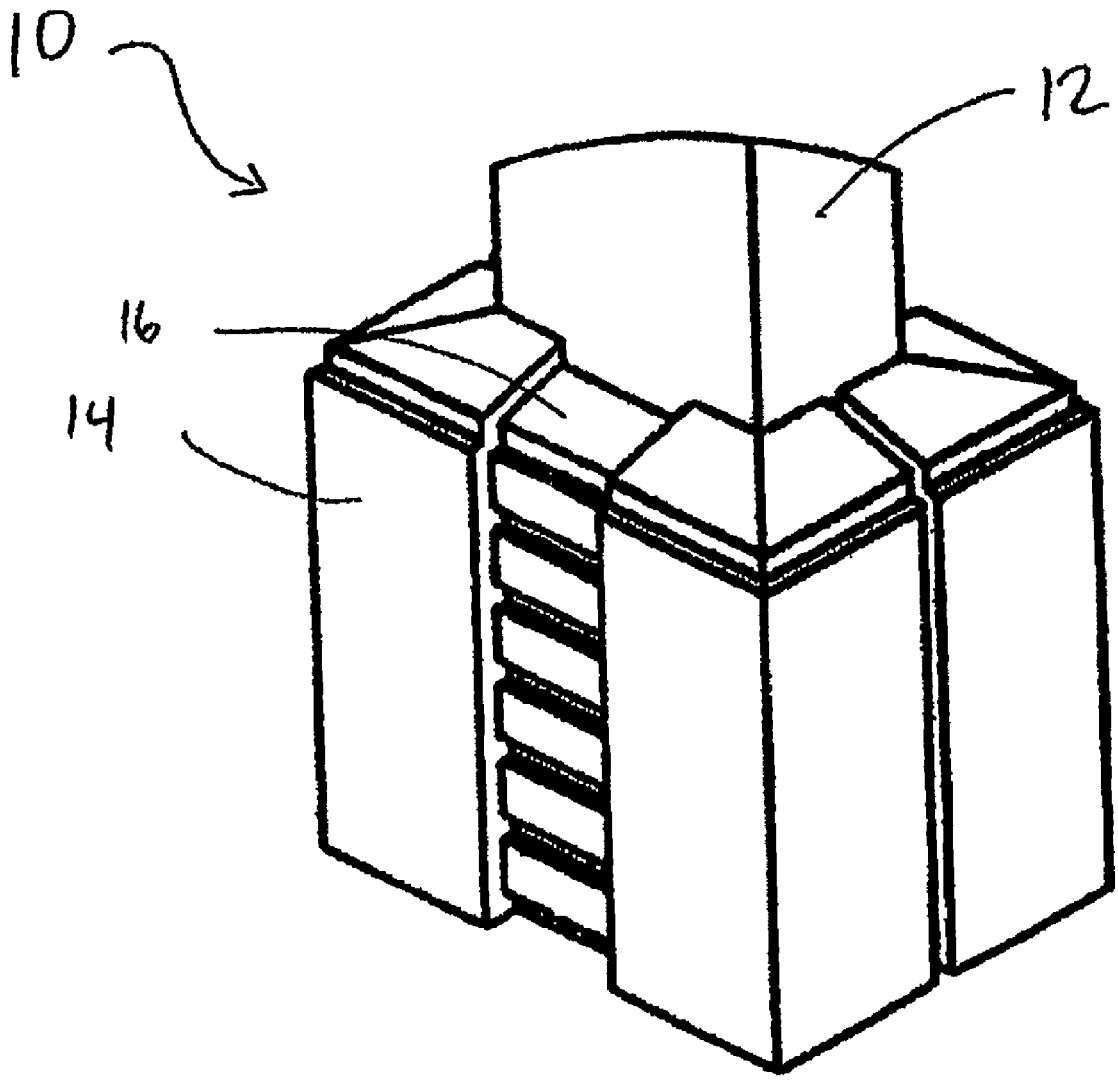
FIG. 1 is a perspective view of one embodiment of an assembled post wrap device in place around a post.

FIG. 1 is a perspective view of an assembled post wrap apparatus 10, which has been applied around a rectangular post 12. The post wrap apparatus 10 comprises four corner components 14, each of which is configured to slidably interact with an intermediate component 16, one on each of the two sides of the corner component 14. In this way, it can be seen that such a post wrap apparatus 10 can be assembled around a post after the post is fixed into place, without the need to slide the assembled apparatus down over the top of the post. Thus, the post wrap apparatus 10 can be readily placed around the post base at any time during or after construction of the structure supported by the post 12, and may also be removed or adjusted at any time.

Figure 2A:
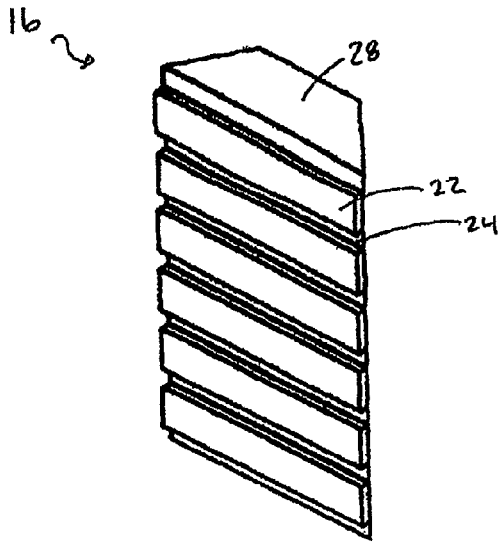
FIG. 2A is a perspective view of an intermediate component of the post wrap device of FIG. 1.

With respect to FIG. 2A, it can be seen that, in the illustrated embodiment, the intermediate component 16 comprises an exterior face 20 having positive rail features 22 extending horizontally along the exterior face 20. These rail features 22 serve to define negative groove features 24 which are configured to receive corresponding glides, or rail features, located on the corner components to be describe hereinafter with reference to FIG. 3A. The mating relationship of the grooves 24 and the glides facilitates the slidable and adjustable interconnection of the two components. In the illustrated embodiment, several such rail and groove features are provided on the intermediate component, in order to provide a secure connection, as well as an aesthetically pleasing appearance. However, it will be understood that in other embodiments, fewer or greater numbers of rail and groove features may be provided on the intermediate components. In addition, it will be understood that other shapes may be utilized to permit the desired slidable interconnection.

Figure 2B:
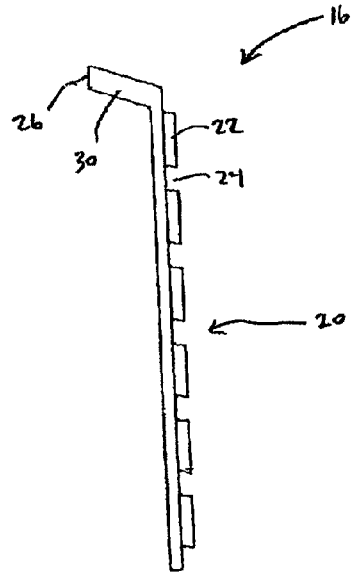
FIG. 2B is a side view of the intermediate component of FIG. 2A.
Figure 2C:
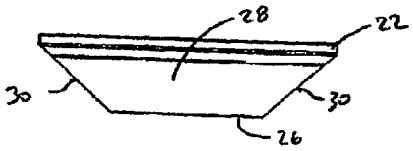
FIG. 2C is a top view of the intermediate component of FIG. 2A.
Figure 2D:
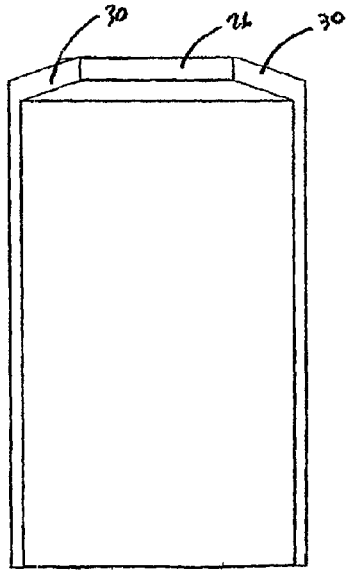
FIG. 2D is another side view of the intermediate component of FIG. 2A.
Figure 3A:
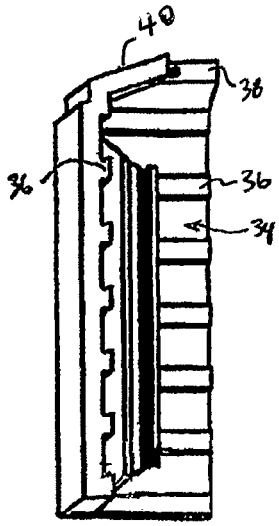
FIG. 3A is a perspective view of a corner component of the post wrap device of FIG. 1.

As can be best seen in FIG. 2B, in a preferred embodiment, the underside of the rail features 22 is undercut slightly, and the corresponding rail features on the corner component will have a complimentary profile (See, e.g., FIG. 3A). This undercut constrains movement of a corner component relative to an interlocked intermediate component to a direction parallel to the axes of the groove features, preventing the corner component from moving away from a surface of the post without the intermediate component moving, as well.

The intermediate component 16 also comprises an interior vertical face 26, which is configured to be positioned flush against a face of the post when the post wrap apparatus 10 is in an assembled state. The component 16 also comprises an upper surface 28, which in preferred embodiments slopes downwards away from the interior face 26, so that water runs off the surface 28, away from the post. Intermediate component 16 also comprises two angled side faces 30, one on each side of the intermediate component. In a preferred embodiment, the angled side faces 30 are arranged at a 45 degree angle to the front face 20 and interior face 26, such that if necessary, one intermediate component 16 can be brought into contact with another intermediate component 16, in order to adjust the size of the perimeter defined by the upper portions of the post wrap device in order to snugly fit against a post having a small dimension.

It can be seen by reference to FIG. 3A that the corner component 16 comprises two vertical interior faces 34 oriented orthogonally to one another. Glides 36, which are elongated members having a constant cross-sectional shape, are located on each of these interior faces 34, and configured to slidably interconnect with the grooves 24 on the exterior face 20 of the intermediate components 16. These glides 36 extend horizontally, in the illustrated embodiment, from one edge of the interior face to the other. In preferred embodiments, the glides 36 have an undercut on their upper surface, so that matching edge on the rail 22 on the intermediate component 16 covers the glides, and prevents water retention on the interior of the post wrap apparatus.

Referring again to FIG. 3A, corner component 14 also includes upper interior faces 38, which like the interior face 26 of intermediate component 16, are configured to be positioned flush against the sides of the post 12 when the post wrap apparatus is assembled. The corner component 14 further includes upper portions 40, which are preferably sloped at the same angle as the upper surface 28 of the intermediate component, such that the intermediate component can slide underneath the upper portions 40. In further embodiments (not shown), the corner component may comprise a spacer member located near the bottom of the corner component, which extends outward from the vertical interior faces 34 and is configured to contact the surfaces of the post, preventing the lower portion of the corner component from being pulled too far towards the post.

Figure 3B:
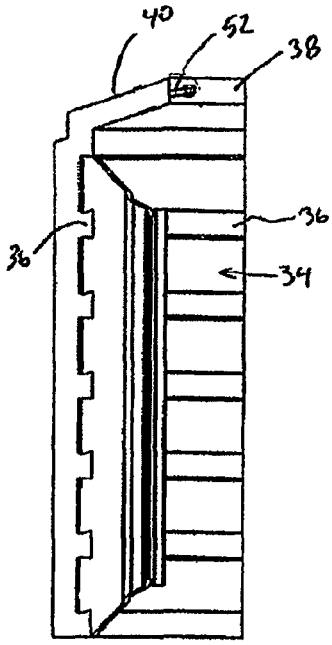
FIG. 3B is a side view of the corner component of FIG. 3A.
Figure 3C:
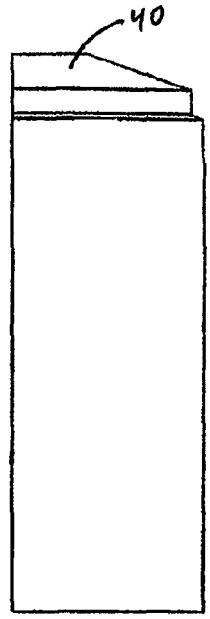
FIG. 3C is another side view of the corner component of FIG. 3A.
Figure 3D:
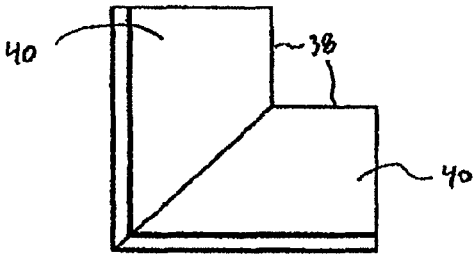
FIG. 3D is a top view of the corner component of FIG. 3A.
Figure 3E:
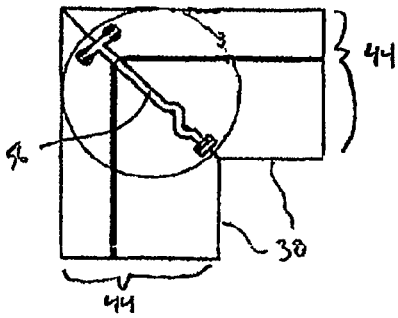
FIG. 3E is a view from underneath the corner component of FIG. 3A.

In the illustrated embodiment, as best seen in the bottom plan view of FIG. 3E, the corner component may be formed from two separate pieces 44 which are then joined together to form the corner component. Such a process advantageously simplifies the fabrication of the post wrap apparatus components, permitting the use of, for example, an extrusion process to fabricate the components in an inexpensive manner. In the illustrated embodiment, it can be further seen that the two pieces 44 are joined together through the use of a spline 46 within a cavity 48, also referred to as a kerf, which extends into each of the two pieces 44 and runs vertically through the corner of the corner component 14. The pieces 44 can then be joined together through, for example, filling the remainder of the cavity 48 with a curing sealant. The spline 46 can preferably have a contoured surface, as shown, in order to enhance the retention of the sealant, preventing the spline from being pulled away from the surrounding sealant. As can be seen in FIG. 3B, a chamfered spine 52 can be used in a similar fashion to join the upper portions 40 to one another.

Figure 3F:
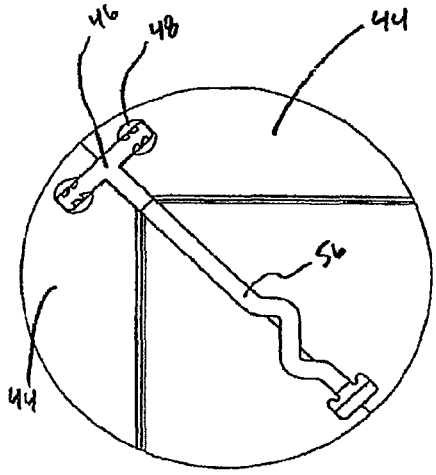
FIG. 3F is a detailed view of section 3F of FIG. 3E.

As can also be seen in FIG. 3E, in the illustrated embodiment the spline 44 forms a portion of a spring member 56, which extends inward from the interior of the corner component 14 towards the post. This can be seen in greater detail in FIG. 3F, which is a detailed view of a portion of FIG. 3E. As will be discussed in greater detail below, the spring member 56 extends from the corner component 14 to a location where it is fixed to the post, and the restoring force of the spring serves to hold the corner component, and particularly the interior faces 28 of the corner component, secure against the surfaces of the post 12.

Figure 4B:
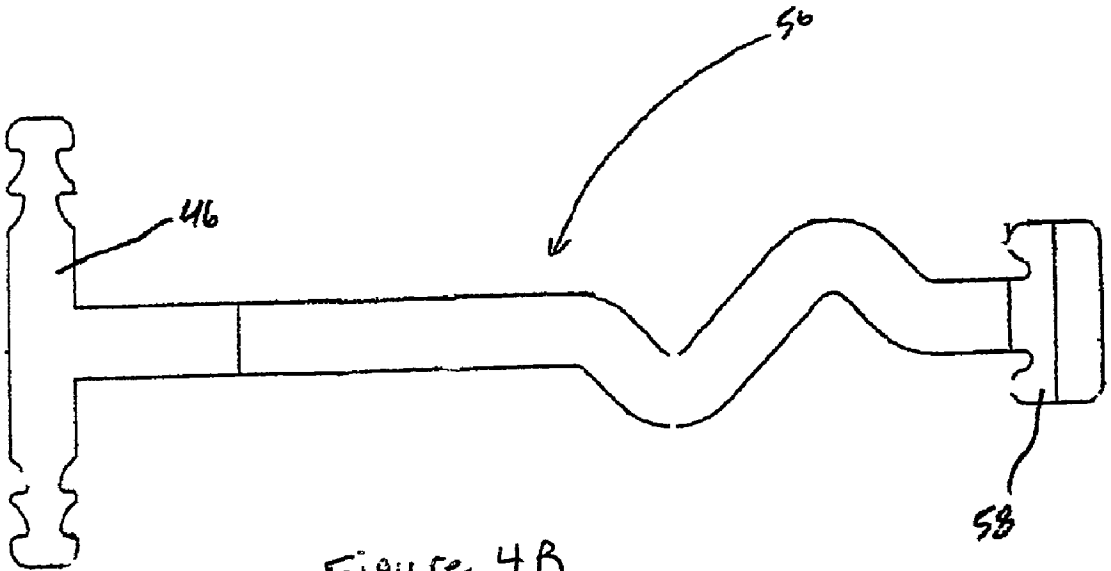
FIG. 4B is a cross-section of the spring member of FIG. 4A.
Figure 4A:
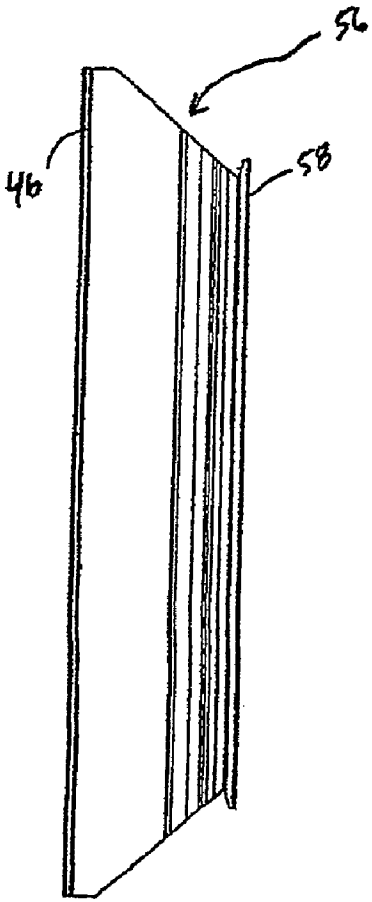
FIG. 4A is a side view of a spring member which may be utilized in conjunction with the corner component of FIG. 3A.

FIG. 4A depicts a side view of the spring member 56, which in the illustrated embodiment comprises a single elongated piece. In one embodiment, the spring member 56 is a polymeric spring member. In some embodiments, the spring member 56 may be fabricated by an extrusion process, and may comprise a polymeric material such as acetal or noryl. As can be seen in FIG. 4B, a cross-sectional view of the spring member 56, the spring member comprises a glide 58 on the end of the spring member opposite the spline 44. In alternate embodiments, the spring member 56 may be a component distinct from the spline 44, particularly in embodiments in which a spline is not used to join the corner component 14 together. The spring member may also be shaped differently. For instance, the spring member may not comprise an elongated portion extending along most of the length of the corner component, or more than one spring member may be included per corner component.

Figure 5A:
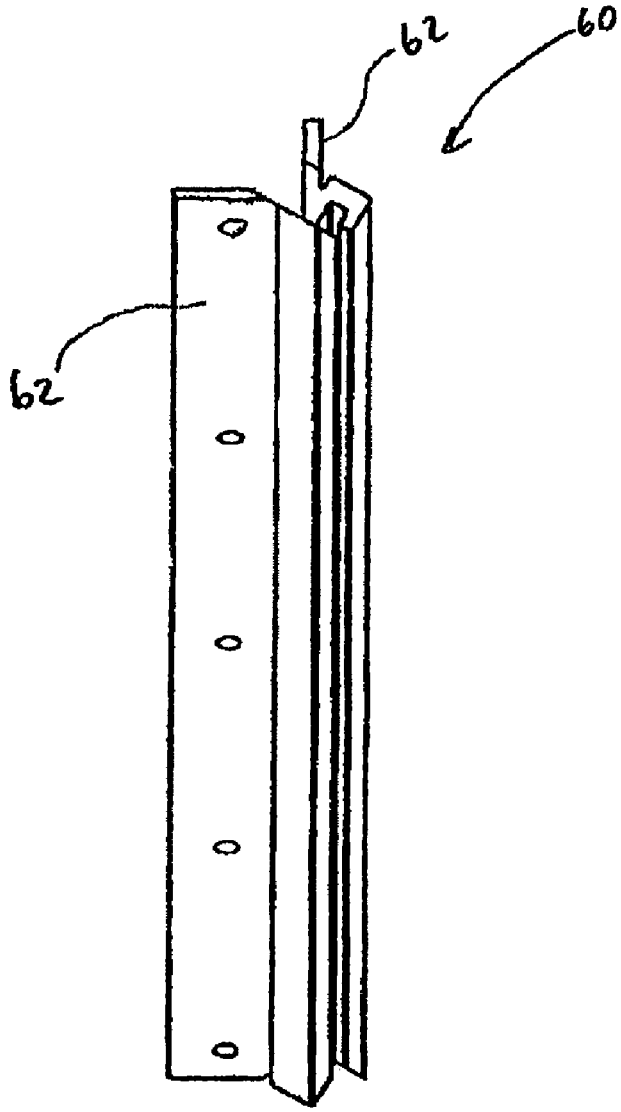
FIG. 5A is a perspective view of a bracket which may be utilized in conjunction with the corner component of FIG. 3A.
Figure 5B:
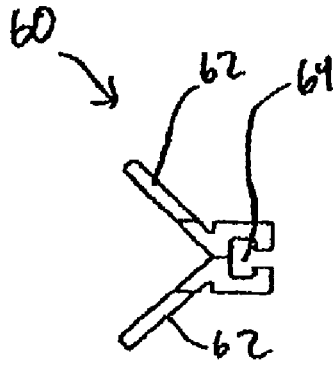
FIG. 5B is a cross-section of the bracket of FIG. 5A.

FIGS. 5A and 5B depict a bracket 60, also referred to as a post slide or a sliding latch, which may be secured to a corner of the post prior to the securing of the post wrap apparatus around the post. FIG. 5A is a perspective view of the bracket 60 and FIG. 5B is a cross-section of the bracket. The bracket 60 comprises wings 62 which can be used to secure the bracket to the post, as well as a channel 64 running the length of the bracket, configured to receive the slide 58 of the spring member 56. As can be seen in the perspective view of FIG. 5A, the upper portion of the bracket may be notched to facilitate reception of the slide 58.

Figure 6A:
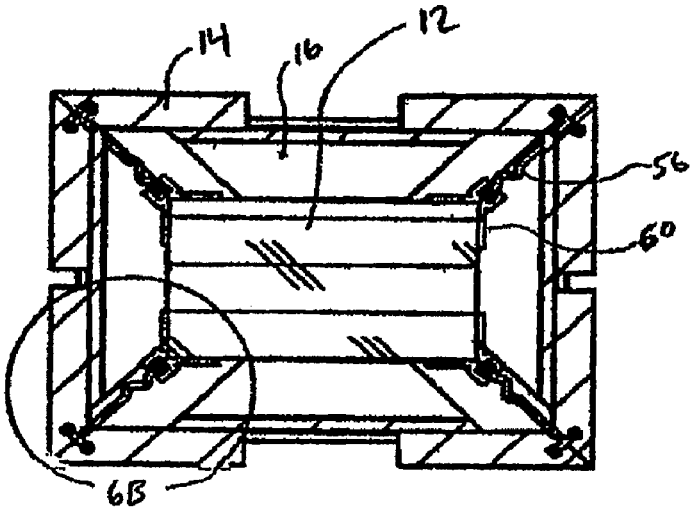
FIG. 6A is view from underneath the assembled post wrap device of FIG. 1.
Figure 6B:
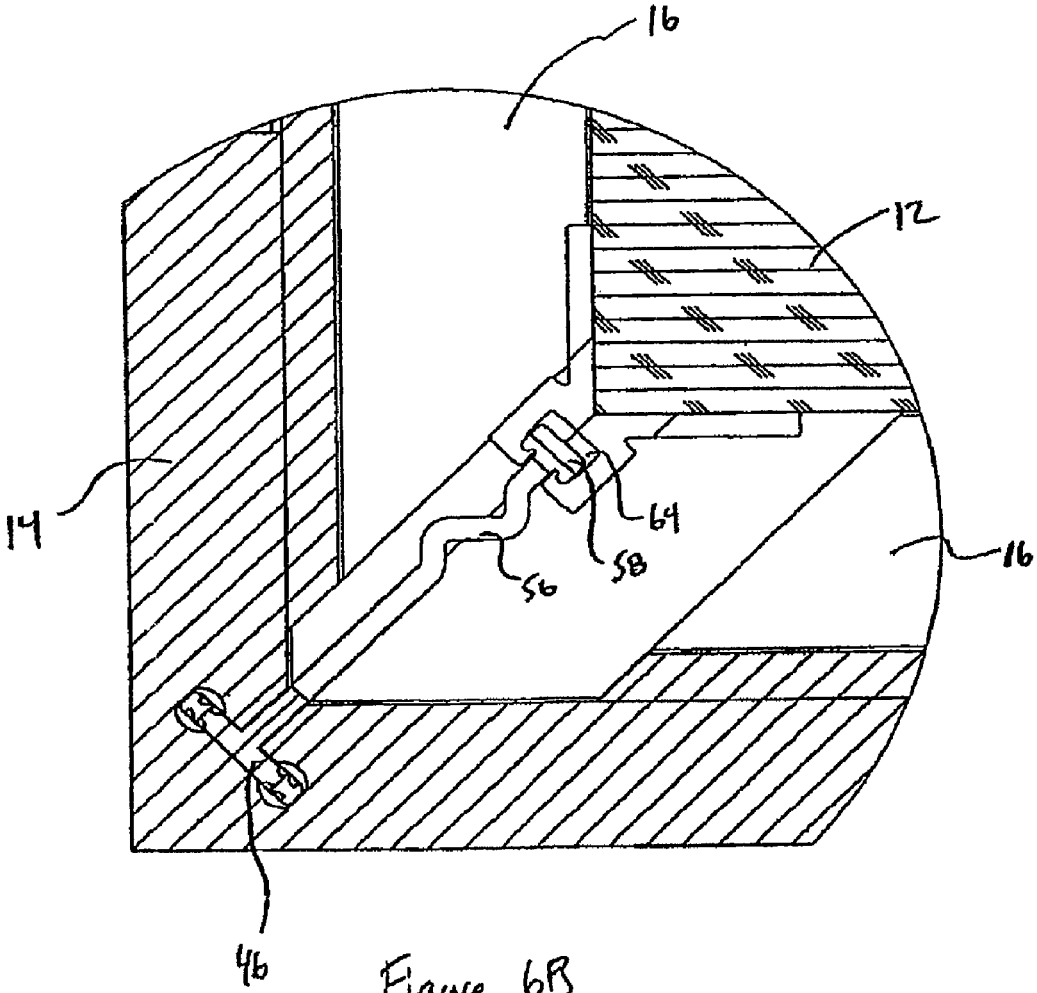
FIG. 6B is a detailed view of section 6B of FIG. 6A.

FIG. 6A depicts a cross-section of the assembled and secured post wrap apparatus, and FIG. 6B is a detailed cross-section of one corner of the post wrap apparatus. As can be seen, the bracket 60 has been secured to the post 12. The glide 58 of the spring member 56 has then been received by the channel 64 of the bracket 60. The restoring force of the spring member secures the corner component 14 flush against the corner of the post 12, and the corner components 14, in turn, pull the intermediate components 16 against the surfaces of the post 12. Advantageously, because the components are held in place by the restoring force of the spring members, and are not fixed relative to one another, the post wrap apparatus will be self-adjusting if there is any change in the cross-sectional dimensions of the post over time.

In one embodiment, a process for applying such a post wrap apparatus to the base of a post includes first securing the brackets 60 to the post 12. The corner components 14 and the intermediate components 16 may then be fixed to one another around a location on the post 12 located away from the brackets 60, defining a perimeter around the post. Typically, the components 14 and 16 will be assembled at a location on the post which is farther from the base of the post than the brackets are from the base of the post. The corner components 14 and the intermediate components 16 are then brought towards the brackets 60 so that the glides 58 of the spring members 56 enter and are retained by the channels 64 of the brackets 60.

Figure 7A:
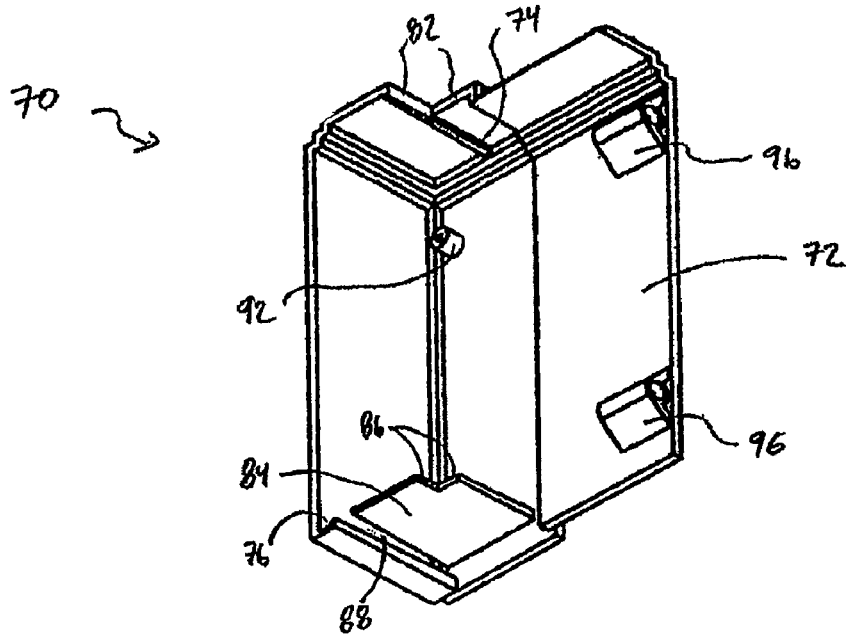
FIG. 7A is a perspective view of a corner component which forms a part of an alternate embodiment of a post wrap device.
Figure 7B:
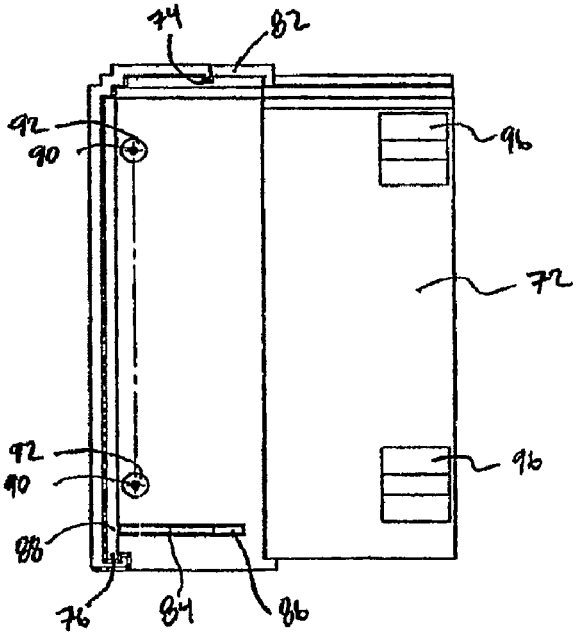
FIG. 7B is a side view of the corner component of FIG. 7A.
Figure 7C:
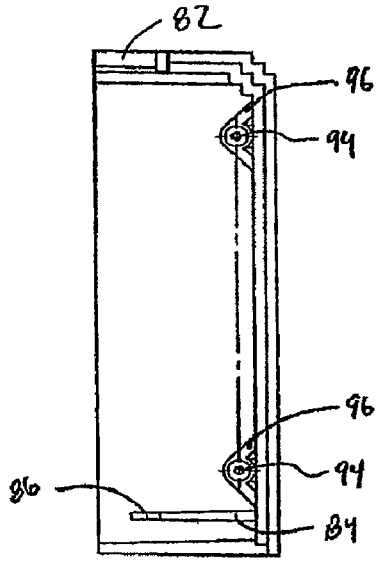
FIG. 7C is another side view of the corner component of FIG. 7A.

In a second embodiment a post wrap apparatus 70 comprises a plurality of corner components as depicted in FIGS. 7A-7C. In this embodiment, no intermediate components are utilized. Rather, each corner component 70 comprises a wing portion 72 extending from one side of the corner component, and configured to slidably interconnect with an open side 73 another corner component 70.

Referring now to FIG. 7A, the open side 73 of the corner component 70, configured to receive and retain the wing portion 72 of the adjacent corner component, comprises features designed to constrain movement of the wing portion in undesirable directions. In this embodiment, the corner component 70 comprises a protrusion 74 extending from the upper interior surface of the corner component. This protrusion 74 is configured to restrain the upper portion of the wing portion 72, which in this embodiment is a raised member extending the length of the upper interior surface of the corner component in a direction parallel to the wall of the open side 73. The corner component 70 also comprises a groove 76 configured to receive and retain the lower portion of the wing portion 72, and defined by a lipped member located near the base of the corner component extending horizontally along the open side 73 of the corner component 70.

As with the corner component 14 discussed above, the corner component 70 comprises two upper interior faces 82 orthogonal to one another, and configured to contact the surfaces of the post. The corner component 70 also comprises a spacer member 84, which in the illustrated embodiment is a substantially horizontal planar member extending from the interior walls of the corner component and located near the base of the corner component. The spacer member 84 has a notched corner which defines two interior faces 86 configured to contact the surfaces of the post and prevent the lower portion of the corner component from sliding inwards toward the post. A gap 88 is provided between the spacer member 84 and the wall of the corner component 70 in order to accept a wing portion 72 of another corner component.

As can be seen in FIG. 7A, the corner components 70 in the illustrated embodiment comprise two apertures 90 which extend through a wall of the corner component and through two bosses 92 located on the interior of the corner components. It can be seen, in the illustrated embodiment, that the apertures are located the same distance from the corner of the corner component, with one of the apertures located near the upper surface of the corner component and the other located near the base of the corner component. The wing portions 72 also comprise a pair of bosses 94 having apertures 96 extending through them. The respective bosses 96 are at the same heights as the respective bosses 92, and the apertures 90 of bosses 92 are aligned with the apertures 94 extending through bosses 96, such that a fastener can be inserted through the upper boss 92 of a first corner component and extend through the upper boss 96 of a second corner component.

Figure 8A:
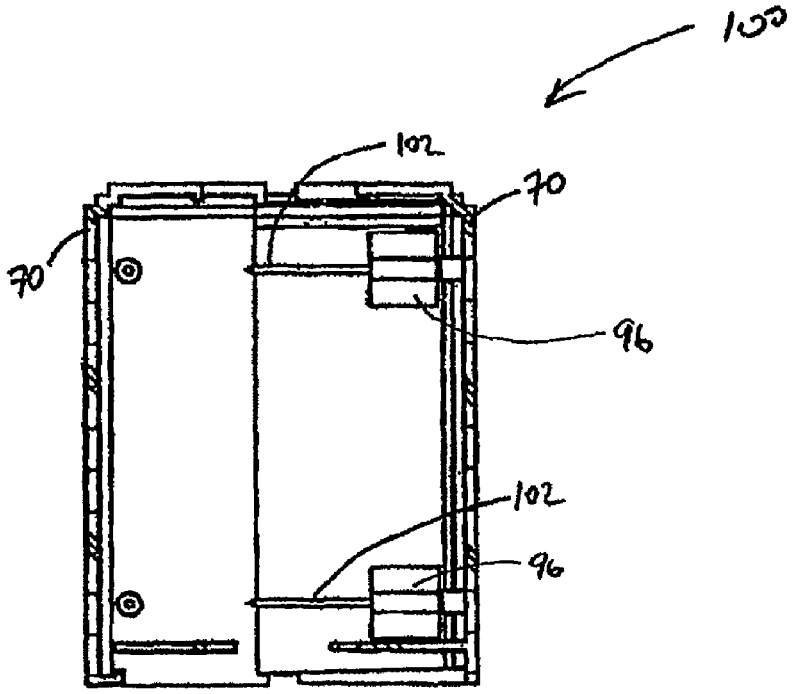
FIG. 8A is a cross-section of an assembled post wrap device utilizing the corner components of FIG. 7A.
Figure 8B:
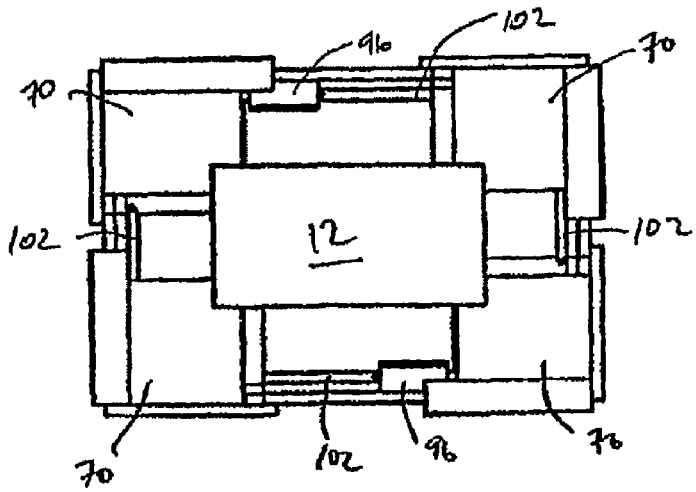
FIG. 8B is a view from underneath the assembled post wrap device of FIG. 8A.

FIG. 8A depicts a side view of the assembled post wrap apparatus 100, and FIG. 8B depicts a view of the assembled post wrap apparatus from underneath. It can be seen in FIGS. 8A and 8B that the corner components 70 have been slidably interconnected with one another. Subsequently, fasteners 102 have been inserted through the apertures 90 of bosses 92 of one corner component 70, and into the apertures 94 of bosses 96 located on the wing section 72 of another corner component, securing the corner components to one another. In one embodiment, the bosses 96 comprise a threaded insert, and the fastener 102 comprises a threaded screw, such as a machine screw. In another embodiment, the fastener 102 comprises a self-tapping screw.

It will be understood that the post wrap apparatus is thus adjustable to allow coverage of posts having a wide variety of dimensions, as the distance which the wing portion of one corner component is inserted into the adjacent corner component can be varied. While this post wrap apparatus 100 is not self-adjusting to subsequent variations in post size, the post wrap apparatus retains the advantages of being installable at any point in the construction process and adjustable to fit a wide variety of post dimensions. Further, the post wrap apparatus can be easily adjusted manually to accommodate subsequent changes in post dimensions.

Figure 9A:
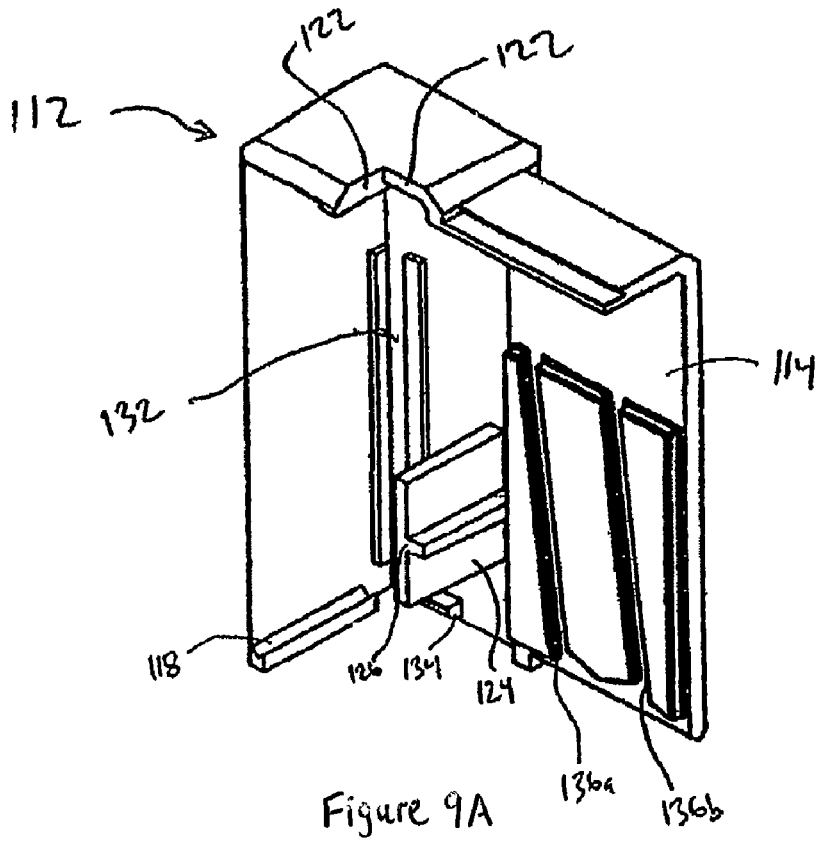
FIG. 9A is a perspective view of a corner component which forms part of another embodiment of a post wrap device.
Figure 9B:
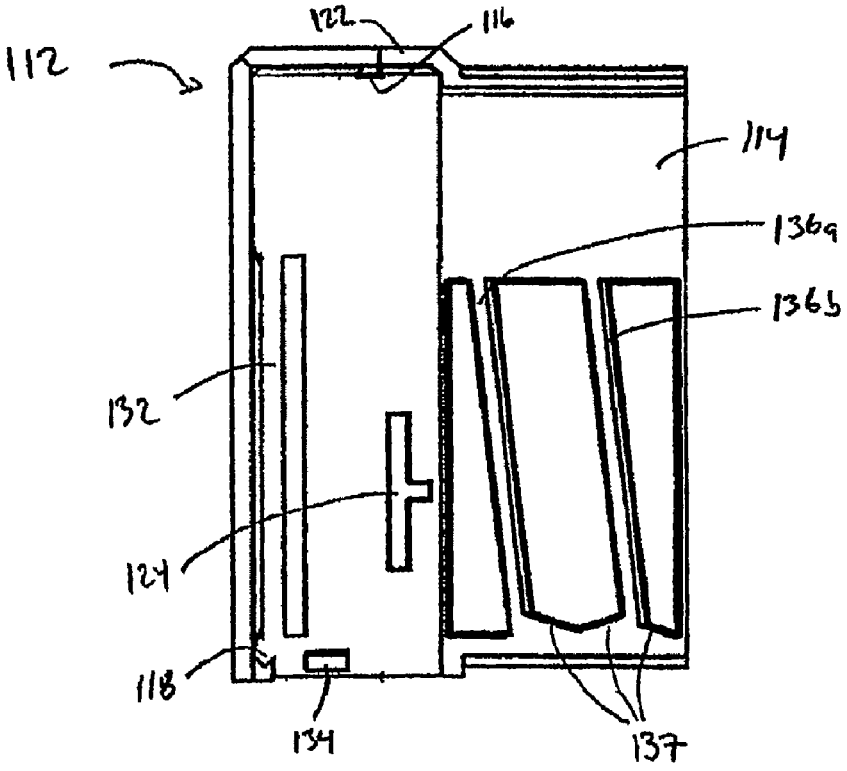
FIG. 9B is a side view of the corner component of FIG. 9B.

In a third embodiment, components of which are illustrated in FIGS. 9A-9B and 10A-10D, a post wrap apparatus comprises a plurality of corner components 112, described herein with respect to FIGS. 9A-9B, and a plurality of sliding spring clamps 140 described in greater detail below with respect to FIGS. 10A-10D. FIG. 9A is a perspective view of a corner component 112, and FIG. 9B is a side view of the corner component. To some extent, the design of the corner component 112 is similar to the design of the corner components 70 discussed above. The corner component 112 also includes a wing portion 114 which is configured to slidably interconnect with a wing portion of an adjacent corner component. In order to prevent the wing portion 114 of an interlocked corner component from moving towards or away from the post, the corner component 112 includes a raised member 116 extending across the upper interior surface of the corner component which is configured to restrain an upper portion of a wing portion 114. The corner component 114 also includes a groove 118 defined by a lipped member extending along the length of the open side 115 of the corner component near the base of the component, where the lip member is shaped to receive and retain the lower portion of a wing portion 114.

In addition, the corner component comprises two upper interior faces 122 orthogonal to one another, and configured to contact the surfaces of the post. The corner component 112 also comprises a spacer member 124 extending outward from the wing side of the corner component. The spacer member 124 has an interior face 126 configured to contact the surface of the post parallel to the wing portion 114 and to maintain the desired spacing. The spacer member 124 has a t-shaped cross section wherein the flat surface of the spacer member faces the open side 115 of the corner component 114, providing an area free from obstruction in which the sliding spring clamp, discussed in greater detail below, can be positioned.

In the illustrated embodiment, the corner component 112 comprises a groove 132 located along the interior surface of the corner component on the same side as the wing portion 114 and extending upwards from the base of the corner component to a point more than halfway up the interior surface of the corner component. The groove 132 is configured to receive a first slide, or rail feature, of a sliding spring clamp 140 (not shown). The corner component also includes comprises a stop 134 located near the base of the device and near the groove 132, which is configured to retain the sliding spring clamp. Preferably, the stop 134 has a rounded edge (not shown) facing downward, and a flat edge facing upward, so that a corresponding stop on the sliding spring clamp can be easily passed in one direction, but provide greater retention if the sliding spring clamp is attempted to be moved in the other direction.

The illustrated corner component 112 also includes two parallel grooves 136*a* and 136*b* located on the interior of the wing section and extending down a portion of the wing section, each of which is configured to receive a second slide of the sliding spring clamp. These grooves 136*a* and 136*b* are oriented at an angle to the groove 132.

Referring back to FIG. 9A, it can be seen in the illustrated embodiment that the members 135 extending from the wing portion and defining the grooves 136*a* and 136*b* have lower surfaces which are at an angle to the base of the corner component 112 and are angled toward the grooves, forming lead-in angles 137. The existence of these lead-in angles 137 on the underside of the members 135 greatly facilitates the assembly of the post wrap apparatus. This is because the slide of a sliding spring clamp, such as the slide 146 of the spring clamp 140 discussed below, will be guided naturally towards the appropriate groove when the spring clamp is pushed against the members 135 during the assembly process. This enables "blind" assembly of the final post wrap apparatus, a very helpful feature, as it could be very difficult to see the grooves 136*a* and 136*b* during assembly of the post wrap apparatus around a member.

Figure 10A:
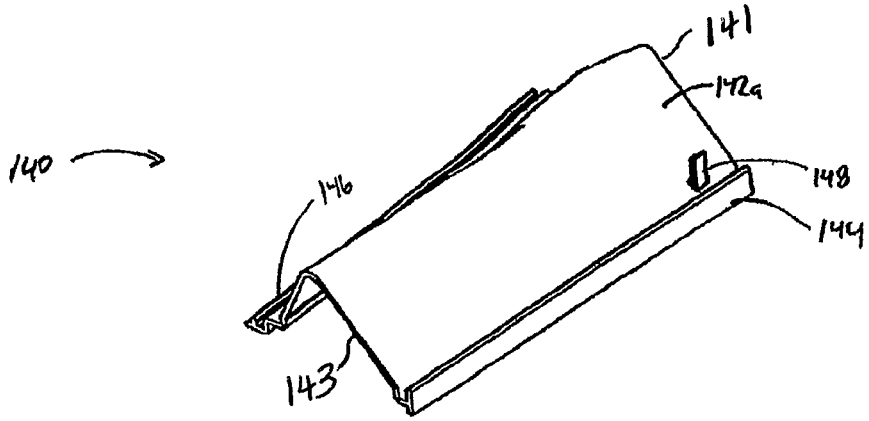
FIG. 10A is a perspective view of a sliding spring clamp which is usable in conjunction with the corner component of FIG. 9A in the post wrap device.
Figure 10B:
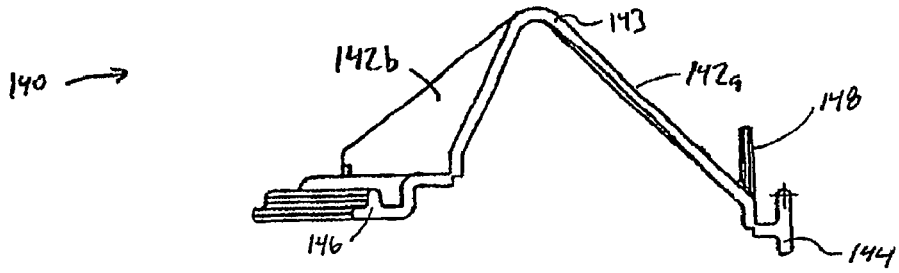
FIG. 10B is a view from underneath the sliding spring clamp of FIG. 10A.
Figure 10C:
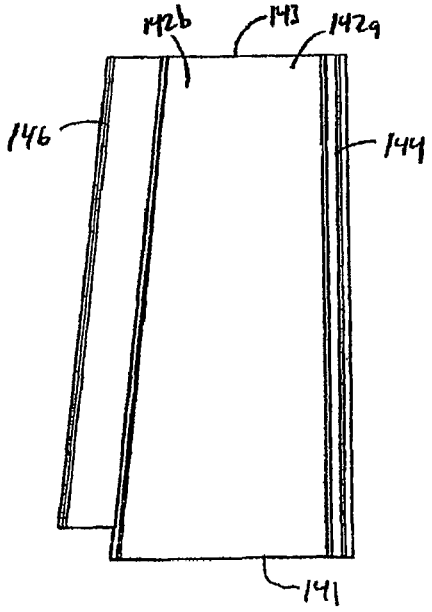
FIG. 10C is a side view of the sliding spring clamp of FIG. 10A.
Figure 10D:
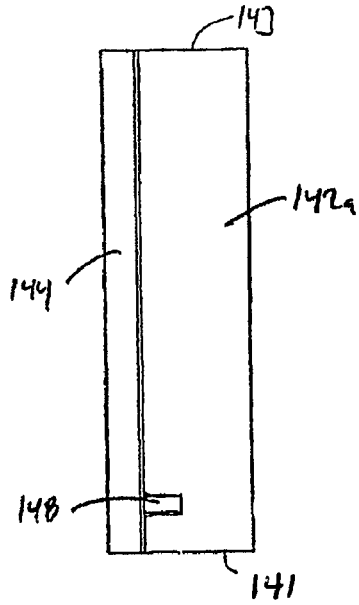
FIG. 10D is another side view of the sliding spring clamp of FIG. 10A.

As can be seen in FIG. 10A, the sliding spring clamp 140 comprises two essentially planar sections 142*a* and 142*b* oriented at an angle to one another, and oriented such that the angle between the two planar surfaces varies over the height of the spring clamp, the angle becoming smaller near the bottom 143 of the spring clamp. The sliding spring clamp 140 also comprises two slides, 144 and 146, located on either side of the spring clamp. Slide 144 is configured to be received vertically by groove 132 on the interior of corner component 112. As with the slide 58 forming a part of the spring member 56, the slides 144 and 146 comprise an elongated section having a substantially consistent cross-sectional shape. The slides 144 and 146 are attached to the rest of the spring clamp by a narrower portion, such that the glide can be slidably inserted into a groove or channel but restrained from moving in a direction orthogonal to the axis of the channel or groove. Slide 146 is oriented at the same angle to slide 144 as the grooves 136*a* and 136*b* are oriented with respect to the groove 132. Slide 146 is thus configured to be received by either groove 136*a* or 136*b*.

With respect to FIG. 10A, it can be seen that a stop 148 is located near the slide 144 and near the top edge 141 of the spring clamp 140, and is configured to contact stop 134 of the corner component 112 and thereby constrain the movement of the sliding spring clamp relative to the corner component, as discussed above. In the illustrated embodiment, the interaction between the stop 134 of the corner component 114 and the stop 148 of the sliding spring clamp 140 permits the spring clamp to be retained in place when the slide 146 is either not inserted into a groove 136*a* or 136*b*, or is only partially inserted into a groove. As each of the spring clamps can be connected to a corner component and held in place via these stops, the spring clips may be so attached in advance, greatly facilitating assembly of the post wrap apparatus.

Preferably, the sliding spring clamp 140 comprises a resilient deformable material, such as a polymeric material. The resilience of the sliding spring clamp permits the spring clamp 140 to be deformed such that the slides 144 and 146 may be pulled away from each other as necessary during assembly of the post cover apparatus, while the restoring force of the spring clamp pulls the slides back toward one another. Advantageously, the slide 146 may be inserted into either of groove 136*a* or 136*b*, depending on the particular dimensions of the post to be covered. In various embodiments, the corner components may comprise more or less than the two angled grooves 136*a*, 136*b*, in order to provide greater or less control over the interior dimensions of the post wrap apparatus 110.

Assembly of the post cover apparatus 110 may proceed as follows. The four corner components 112 are slidably interconnected with one another, defining a perimeter around the post 12. The sliding spring clamps 140 are then oriented such that the glides 144, 146 are positioned to enter their respective grooves, with the top end 141 of the spring clamp (the portion with the larger angle between the two planar sections) facing upwards. The spring clamps are then pushed upwards, pulling the two corner components together as the spring clamps are bent outward as they move upwards. The corner components are thus pulled flush against the post, and the restorative force of the spring claims ensures a snug fit against the post, while still permitting self-adjustment of the post cover apparatus due to variances in post dimensions.

It will be understood by a person having ordinary skill in the art that variations and combinations of the above-described embodiments are contemplated, and are within the scope of the invention. For example, FIGS. 11A-11C illustrate an alternate version of a corner component 150 to be utilized in conjunction with a sliding spring clamp such as the sliding spring clamp 140 of FIG. 10A.

Figure 11A:
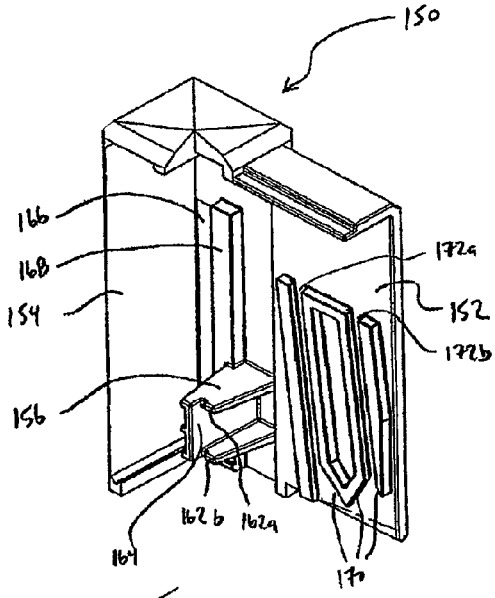
FIG. 11A is a perspective view of an alternate corner component which can be used with a sliding spring clamp.

First with respect to FIG. 11A, it can be seen that the corner component 150 comprises a spacer 156, which takes the form of a vertical planar member extending outward from the wing portion 152 of the corner component. The planar member of the spacer 156 is supported by trapezoidal members at the upper and lower sides of the planar member. The trapezoidal support members are notched on the side of the planar member away from the open side 154 of the corner component 150, resulting in two planar surfaces 162*a* and 162*b* configured to contact one side of the post. The spacer member 156 also includes a portion 164 of the planar member of the spacer 156 which is configured to contact the adjacent side of the post.

Figure 11B:
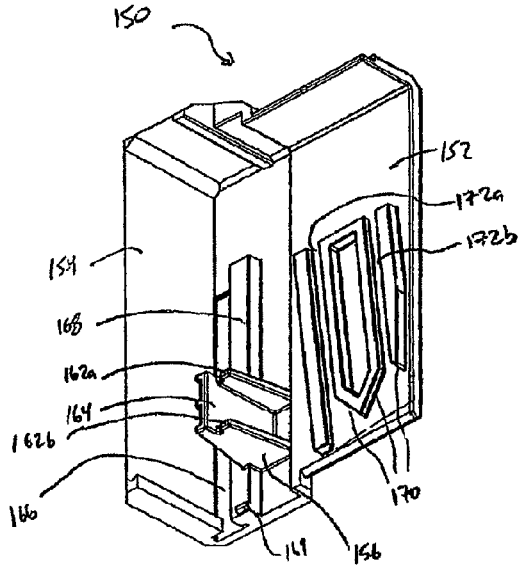
FIG. 11B is another perspective view, seen from underneath, of the corner component of FIG. 11A.

Next, with respect to FIG. 11B, it can be seen that the corner component comprises a shallow channel 166 cut into the wall interior surface of the corner component on the same side as the wing portion 152 and configured to receive a slide of a sliding spring clamp, such as the slide 144 of the sliding spring clamp 140 of FIG. 10A. The channel 166 is covered partially by an elongated member 168 extending slightly farther up the wall along the same portion of the wall as the shallow channel 166. The member 168 comprises a stop 169 extending outward from the wing portion side of the corner component. As discussed above, this stop 169 comprises a tapered or rounded underside, such that it is easier to push a stop on a spring clamp (such as the stop 148 of the spring clamp 140) upward past the stop 169 than it is to pull the spring clamp stop back over the stop 169 when removing the spring clamp.

Figure 11C:
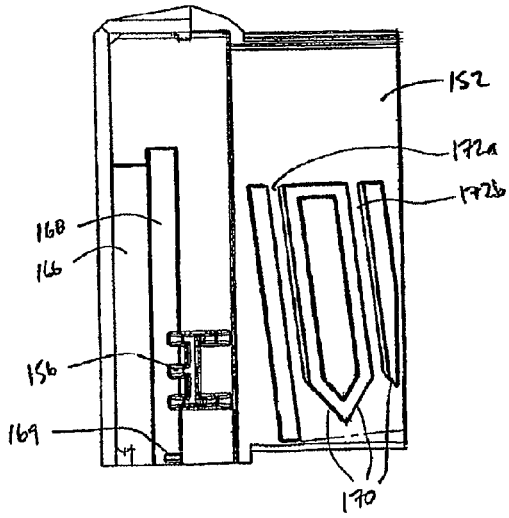
FIG. 11C is a side view of the corner component-of FIG. 11A.

In addition, it can be seen in FIG. 11C that the lead-in angles 170 are more pronounced in this embodiment of a corner component than in the corner component 112 of FIG. 9A. This sharper angle with respect the base of the corner component 150 further facilitates the assembly of a post wrap device, as the glide of a sliding spring clamp (such as the guide 146 of the spring clamp 140) will be more easily directed towards the proper groove of the grooves 172*a* and 172*b*.

Figure 12A:
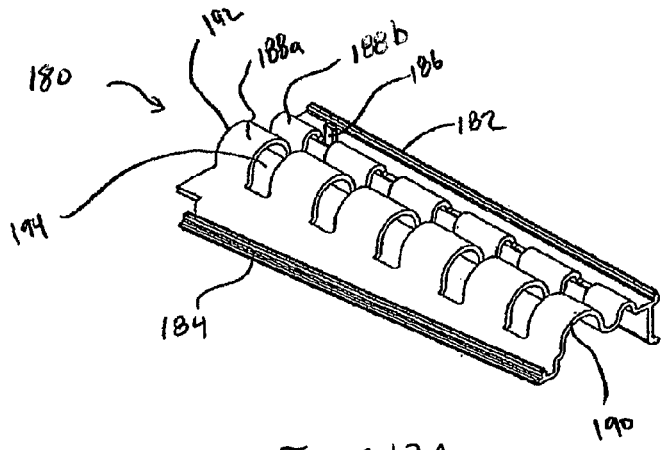
FIG. 12A is a perspective view of an alternate embodiment of a sliding spring clamp, which may be used with the corner component of FIG. 11A.
Figure 12B:
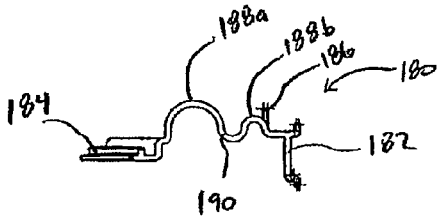
FIG. 12B is a view from underneath the sliding spring clamp of FIG. 12A.
Figure 12C:
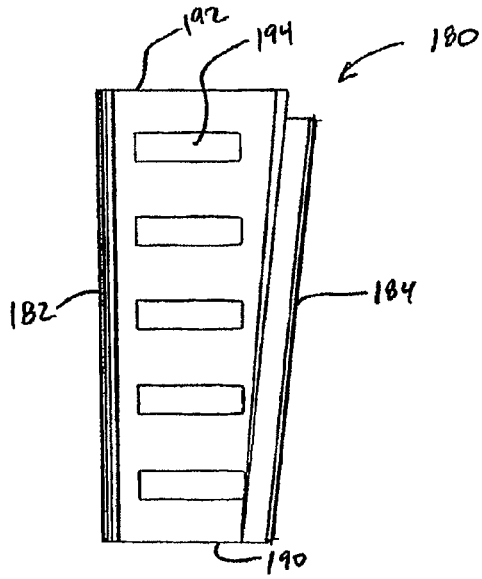
FIG. 12C is a side view of the sliding spring clamp of FIG. 12B.

FIGS. 12A-12C illustrate an alternate embodiment of a sliding spring clamp. With respect to FIG. 12A, it can be seen that like the sliding spring clamp 140 of FIG. 10A, the sliding spring clamp 180 comprises two glides 182 and 184, along with a stop 186 located near the glide 182. As can best be seen in FIG. 12B, however, the portion of the sliding spring clamp 180 between the glides 182 and 184 does not comprise two substantially planar sections, as in the spring clamp 140 of FIG. 10A. Rather, the middle portion of the sliding spring clamp comprises two arched substantially rounded portions 188*a*, 188*b* which extend from the base 190 of the spring clamp to the top edge 192.

By providing multiple bends in the spring clamp between the grooves, the profile of the spring clamp can be advantageously reduced. In particular, by decreasing the distance the spring clamp will extend inward towards the post from the interior surfaces of the assembled post wrap apparatus, the interior surfaces of the corner components may be positioned closer to the post. This permits either a reduction in size of the assembled device as a whole, or the fabrication of corner components having thicker walls without increasing the profile of the assembled post wrap apparatus.

In addition, it can be seen in FIG. 12C that the spring clamp 180 comprises apertures 194 in the middle portion of the spring device, extending through the rounded portions 188*a*, 188*b*. These apertures 194 can be cut into the spring clamp 180 in order to modify the behavior of the spring clamp through a reduction in the restoring force applied by the spring clamp.

Figure 13:
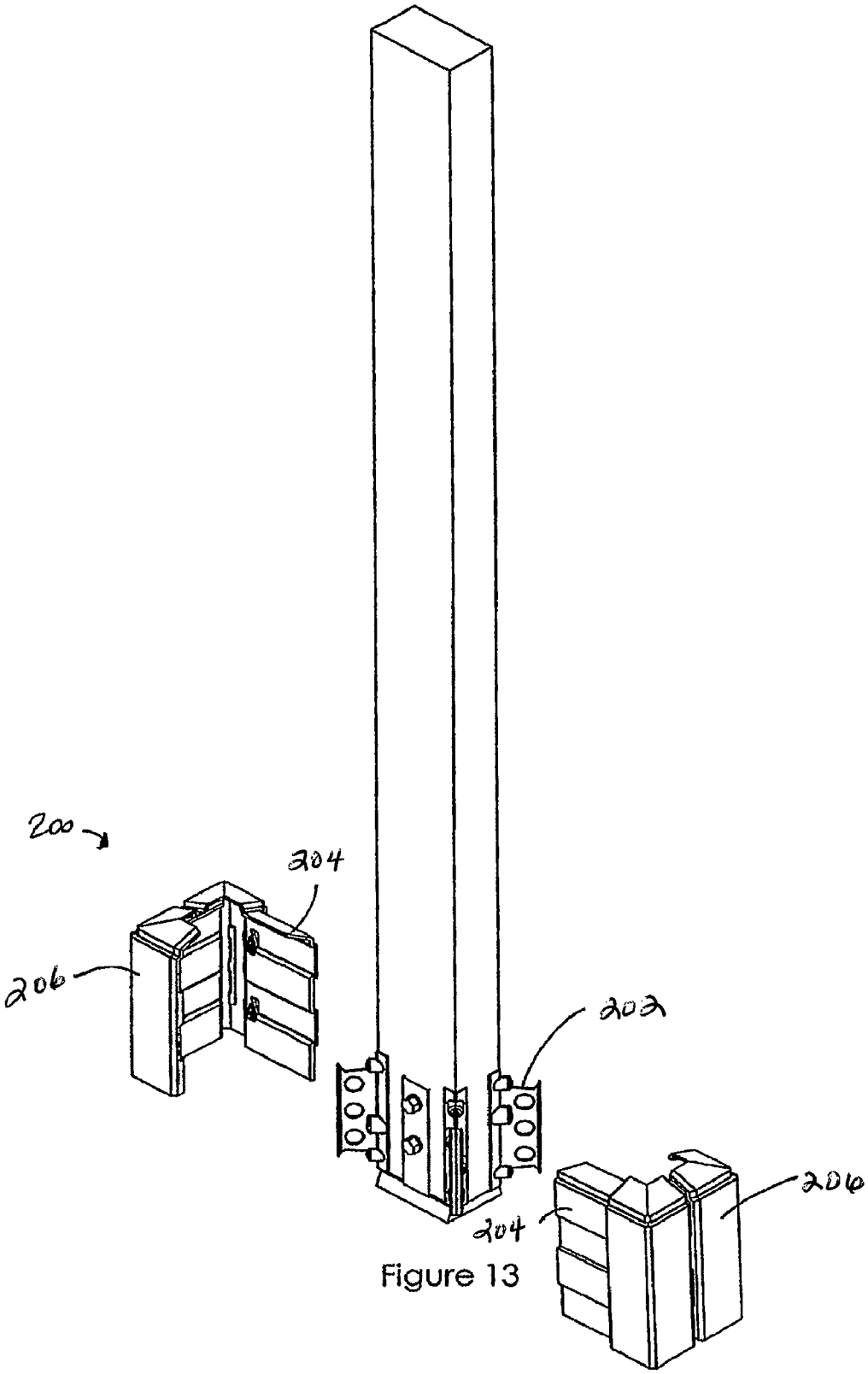
FIG. 13 is an exploded perspective view of an alternate embodiment of a post wrap device.

A further embodiment of a post wrap device is illustrated in FIG. 13, which shows a partially assembled post wrap device 200, which includes post cleats 202, as well as corner components 206 and intermediate panel components 204 configured to extend between and connect the corner components 206. As can be seen, the embodiment of FIG. 13 differs somewhat from the previous embodiments, in that the panel components 204 comprise a reduced number of positive rail features, or glides, 208, as compared to the number of positive rail features 22 on the intermediate component 16 of FIG. 2A. It will be understood that the number of rail features may vary from embodiment to embodiment. It will also be understood that the rail features may constitute the raised portion of a slightly corrugated member, as can be seen in the panel component 204 of FIG. 13, rather than a feature extending from a substantially planar member, as can be seen in the intermediate panel component of FIG. 2A. The structure of the post cleats 202 also differs from previous embodiments, as discussed below with respect to FIG. 14.

FIGS. 14A-14E illustrate various views of a post cleat 202 for use with the post wrap device 200 of FIG. 13. As can best be seen in FIGS. 14A and 14C, the post cleat 202 comprises two elongated members 210*a* and 210*b* oriented orthogonally to one another, the elongated members 210*a,b* having interior faces, each of which is configured to be placed against adjacent faces of the post around which the post wrap device will be placed. It will be understood that although the descriptions herein are directed to a post wrap device for use about a member having a rectangular cross-section, post wrap devices for use with members having other cross-sections (e.g., triangular, hexagonal, etc.) may be provided. In such embodiments, adjustments to the devices described herein, such as the angles between certain members and the numbers of corner and/or panel components, will be adjusted accordingly.

The post cleat 202 also comprises a T-shaped portion 212 attached to the elongated members 210*a,b* at their juncture. In particular, the T-shaped portion 212 comprises a planar portion 214 having an elongated edge which runs along a portion of the juncture of the elongated members. The planar portion 214 of the T-shaped portion is preferably oriented at the same angle to each of the elongated members (e.g., a 135° angle), and may include apertures 216. Along the opposite elongated edge of planar portion 214, an elongated glide member 218 is positioned orthogonally to the planar portion 214. As illustrated, the glide member 218 may extend in one or both directions beyond the main portion of the planar portion 214, such that the edges 220 of the T-shaped portion 212 extend outward, facilitating the placement of the glide 218 in a corresponding groove on the corner component (discussed in greater detail below). Advantageously, the symmetry of both edges 220 permits the post cleat 202 to be installed without regard to the orientation of the post cleat, simplifying the installation procedure.

Figure 14A:
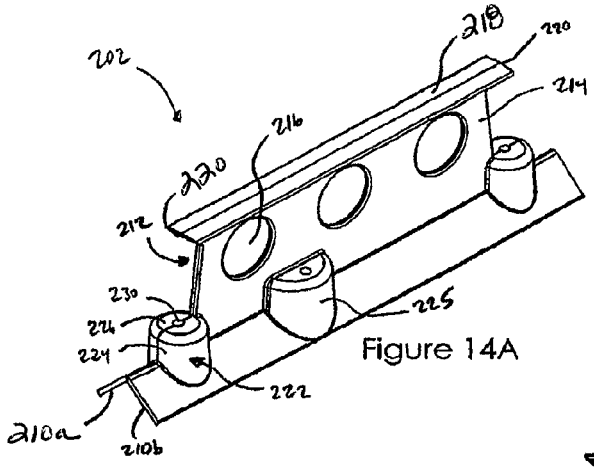
FIG. 14A is a perspective view of a post clamp from the device of FIG. 13.
Figure 14B:
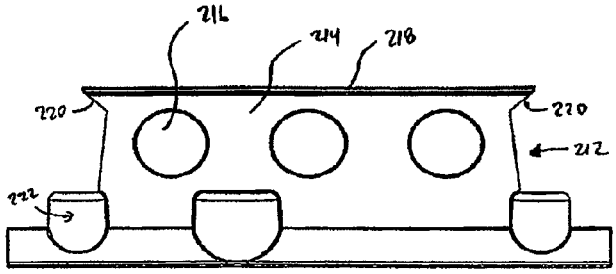
FIG. 14B is a side view of the post clamp of FIG. 14A.
Figure 14C:
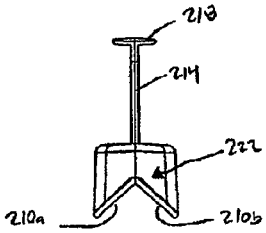
FIG. 14C is a front view of the post clamp of FIG. 14A.
Figure 14D:
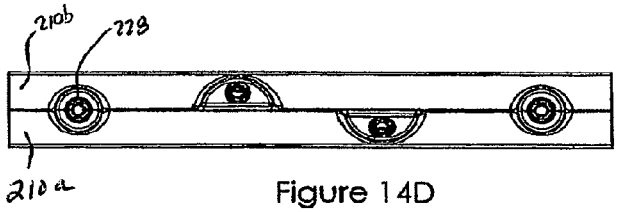
FIG. 14D is a bottom view of the post clamp of FIG. 14A.
Figure 14E:
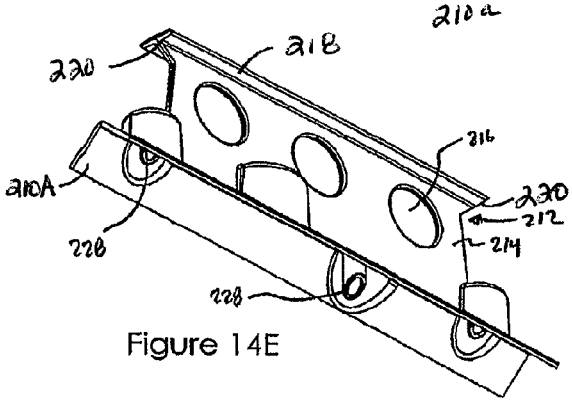
FIG. 14E is a perspective view from below the post clamp of FIG. 14A.
Figure 15A:
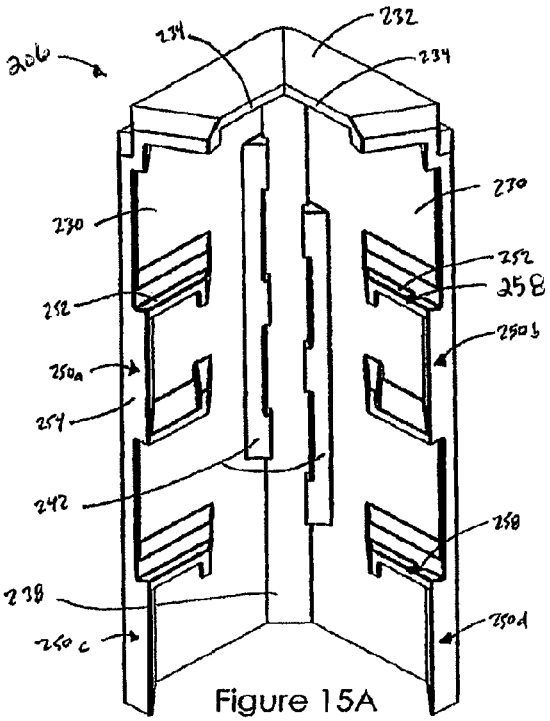
FIG. 15A is a perspective view of a corner component from the device of FIG. 13.
Figure 15B:
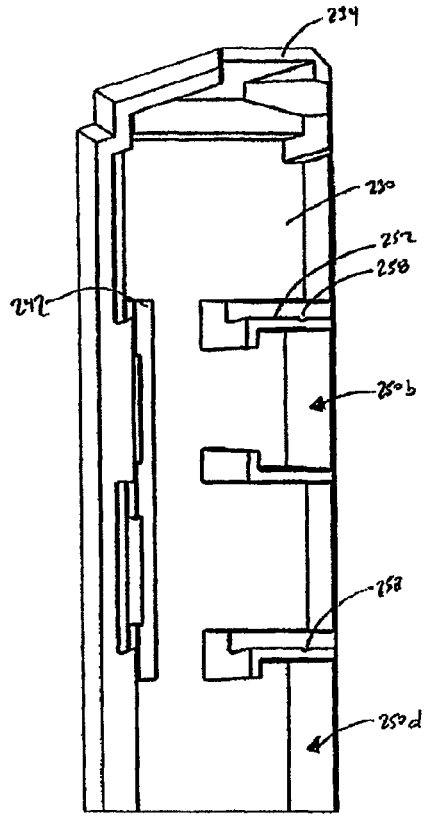
FIG. 15B is a side view of the corner component of FIG. 15A.
Figure 15C:
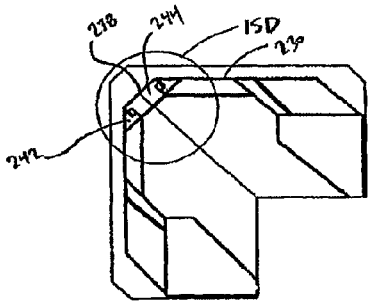
FIG. 15C is a bottom view of the corner component of FIG. 15A.
Figure 15D:
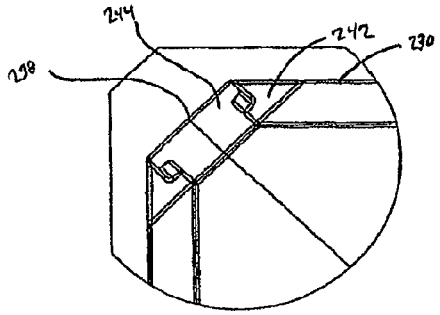
FIG. 15D is a detailed section of FIG. 15C.

In addition, it can be seen that the post cleat contains a plurality of fastener retainers 222. In the illustrated embodiment, the fastener retainers comprise a housing such as outer cylindrical member 224, an upper face 226, and an inner cylindrical member 228 suspended from the upper face. Depending on the placement of the fastener retainer, the housing may alternately comprise a housing 225 having a semicircular cross-section. The inner cylindrical member 228 may have a free end shaped to fit snugly against one or two surfaces of the post, as can be seen in FIG. 14E. The fastener, such as a screw, may be inserted through the aperture 230 in the upper face 226, and be guided by the inner cylindrical member 228, which may be threaded or may be self-threading. To reduce installation effort, fastener threads may be pre-engaged slightly into the inner cylindrical member and presented in this manner for installation. Advantageously, the fasteners enter the post at an angle (e.g., a 45° angle) to the surface of the post, providing securement which may be more reliable than if the fastener entered perpendicular to the surface of the post near the corner of the post. As can best be seen in FIG. 14D, the fastener retainers 222, and in particular the apertures 230, are located both in line with the juncture between elongated members 210*a,b*, as well as on either side of the T-shaped portion 212.

FIGS. 15A-15D illustrate an embodiment of a corner component 206 suitable for use with the post cleat. Similar to the corner component 40 of FIG. 3A, the corner component 206 comprises two vertical interior faces 230 oriented orthogonally to one another, as well as a sloped upper portion 232 extending above each of the interior faces 230. The sloped upper portion comprises a notch having upper interior faces 234 configured to abut the sides of the post when the apparatus is assembled.

Corner component 206 differs from corner component 40 of FIG. 3A in several respects, however. It can be seen in FIG. 15A that the corner component 206 comprises an additional vertical interior face 238 extending between the two interior faces 230, and preferably oriented at the same angle to each of the faces 230 (e.g., a 135° angle). Corner component 206 also includes guide rails 242 attached to the edges of vertical interior faces 230 at either side of the interior face 238. As can be best seen in FIG. 15D, each of the two guide rails 242 has an overhanging lip which together defines a channel 244 extending between the guide rails 242 and the interior face 238, which can be used to retain the glide portion 218 of the post cleat 202. It can also be best seen in 15D that the thickness of the lip decreases near the bottom of the guide rails 242, such that the distance between the lip and the interior face 238 is greater near the lower end of the channel 244, facilitating placement of the glide portion 218 of the post cleat 202 within the channel 244.

Corner component 206 also includes glide structures 250*a, b,c,d* located on each of the interior faces. The number and shape of the glide structures 250 varies depending on the shape of the panel components which will link the various corner components together. As can be seen, the upper glide structures 250*a,b* are substantially C-shaped, comprising a upwardly-tapering upper surface 252 corresponding to the underside of the glide portions of the panel components, and a substantially flat lower surface corresponding to the upper surface of the glide portions of the panel components. The upward taper of the surfaces 252 and the corresponding taper of the glide portions of the panel component serves to retain the panel component against the corner component 206. A vertical edge 254 corresponds in shape to the indentations formed between the glide portions of the panel component, such that the panel component fits snugly against the corner component 206. The lower glide structures 250*c,d* comprise only the tapered upper surfaces 252 and the vertical edges 254. It can also be seen that the glide components 250*b,d* located on one of the vertical walls comprise a notch 258 in the tapered upper surfaces 252. As will be discussed in greater detail below, these notches may be used to secure a panel component to a corner component.

Figure 16A:
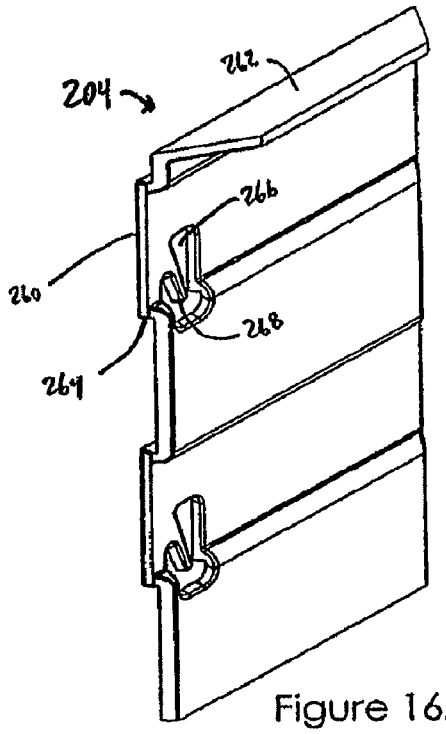
FIG. 16A is a perspective view of a panel component of FIG. 13.
Figure 16B:
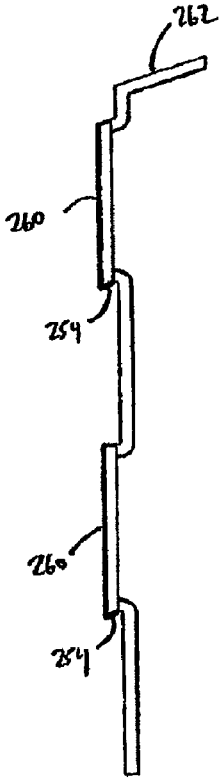
FIG. 16B is a side view of the panel component of FIG. 16A.
Figure 16C:
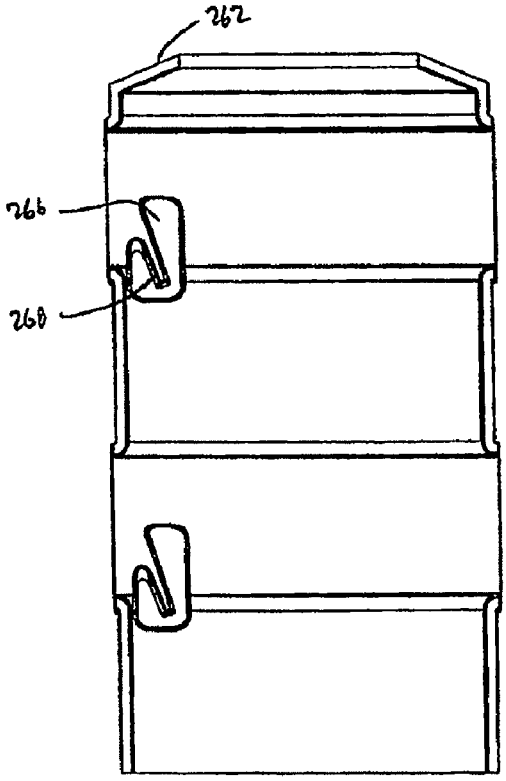
FIG. 16C is a rear view of the panel component of FIG. 16A.

FIGS. 16A-16C illustrate an embodiment of an intermediate panel component 204. As previously noted, it can be seen that the intermediate panel component 204 has essentially constant thickness as compared to intermediate components discussed previously. The intermediate panel component 204 comprises two glide portions 260 as well as a sloped upper portion 262 configured to match the slope of the upper portion of the corner component 206. The glide portions 260 comprise a tapered underside 264 which slopes downward and corresponds to the slope of the upwardly tapering surfaces 252 on the corner component.

The panel component 204 also comprises a cutout section 266 near one side of the component 204 having a resilient toggle 268 which extends slightly lower than the tapered underside 264. When the panel component 204 is mated with the corner component 206, the toggle will deform slightly in contact with the surface 252 of corner component 206, and will rest in the notch 258, prohibiting separation of the panel component 204 from the corner component 206. By prohibiting the retraction of the panel 204 from the corner glide elements 250*b,d* and inhibiting the progression of the panel 204 further into the corner glides 205*b,d*, the resilient toggle 268 facilitates optimal adjustability of the post wrap device.

In one embodiment, assembly of the post wrap device 200 may proceed as follows: The post cleats 202 are secured via fasteners to each corner of the post. The panel components 204 are aligned with the side of the corner component 206 having the notched glide structures 250*b,d*, and slid into place so that the toggles 268 on the panel component 204 engage the notches 258. It will be appreciated that in certain embodiments, the resilient nature of the securement via the toggles 268 and notches 258 will enable the consumer to be provided with corner components 206 already attached to a panel component 204. The components are then arranged about the post, and the panel components 204 are then aligned with a second corner component 206. While the components are located above the post cleats 202, the components are brought together to form a snug fit with each of the surfaces of the post. The assembled components are then slid down the post so that the glide structures 218 on the post cleats engage the channel 244 defined by the guide rails 242, finishing the installation of the completed post wrap device 200.

Figure 17:
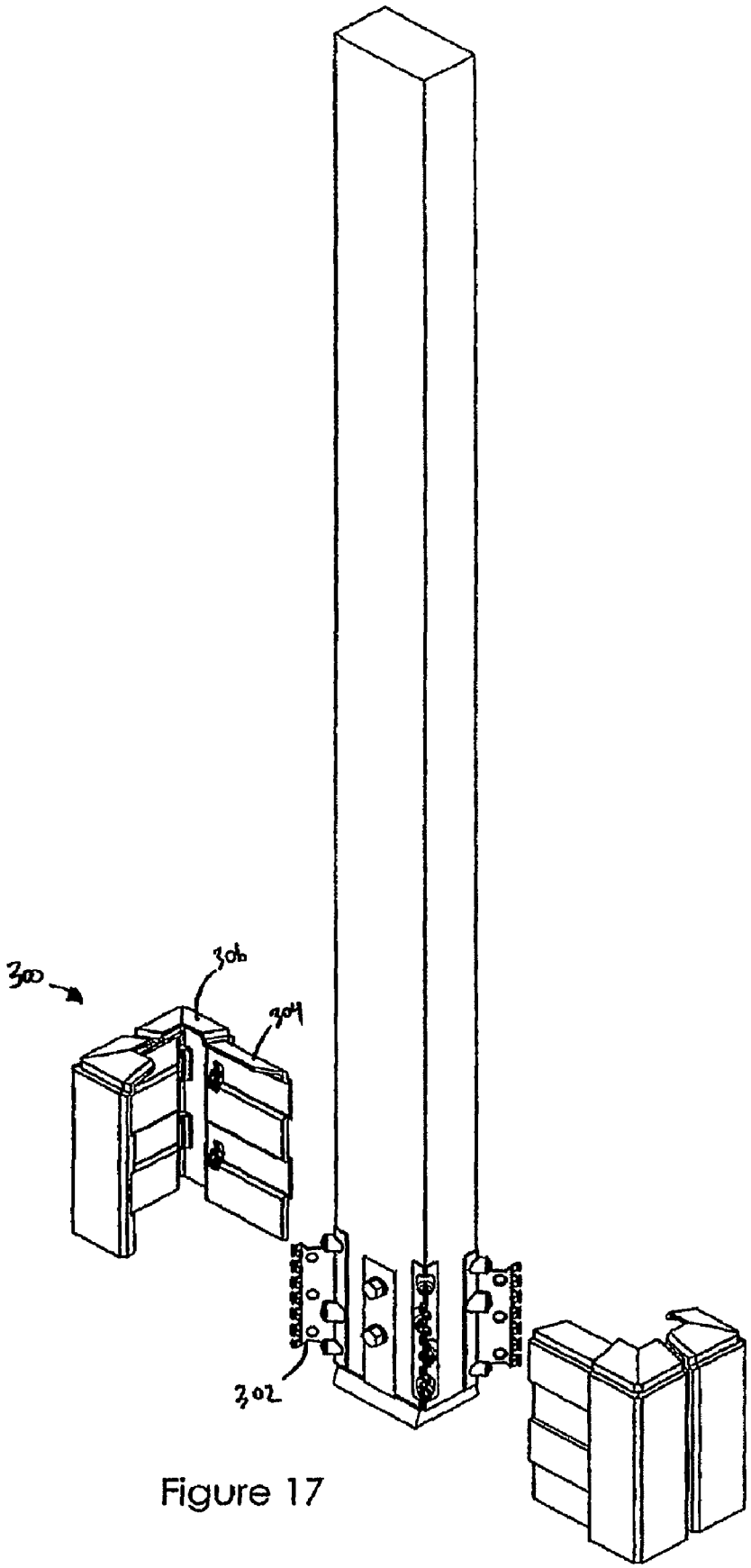
FIG. 17 is an exploded perspective view of an alternate embodiment of a post wrap device.

FIG. 17 illustrates a partially assembled system 300 employing a post cleat 302 having exterior capture features for connecting with the corner component 306, which are themselves interconnected via panel components 204 such as those described with respect to FIGS. 16-16C above.

Figure 18A:
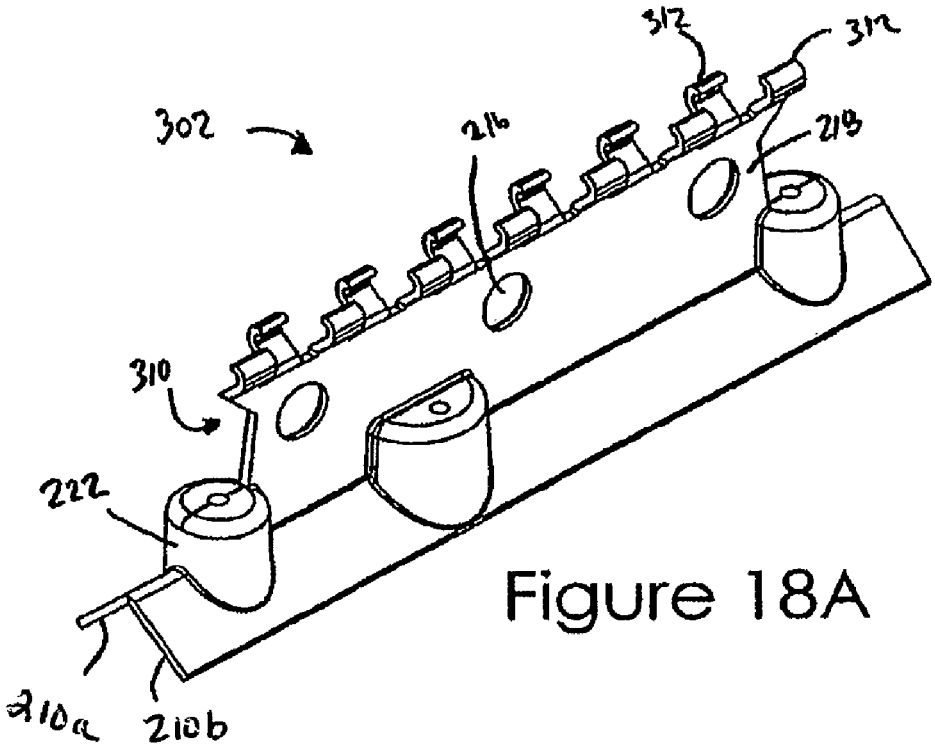
FIG. 18A is a perspective view of a post clamp from the device of FIG. 17.
Figure 18B:
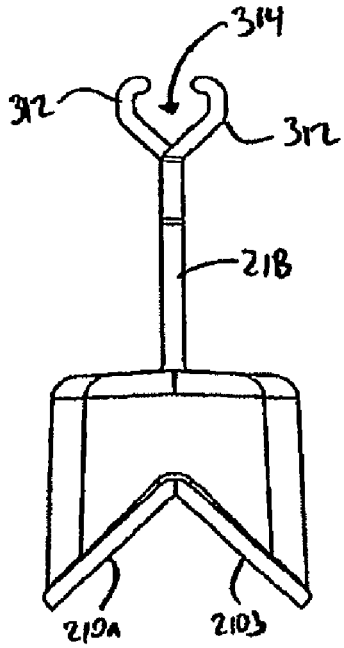
FIG. 18B is a front view of the post clamp of FIG. 18A.

FIGS. 18A-18B illustrate an embodiment of a post cleat 302 comprising external capture features. The post cleat 302 comprises many features similar to that of post cleat 202 of FIGS. 14A-14E, including the elongated members 210*a,b*, the planar portion 214, and the plurality of fastener retainers 222. However, in place of the T-shaped portion 212 of the post cleat 204 of FIGS. 14A-14E, which includes an interior capture feature in the form of an elongated glide member 218, the post cleat 302 comprises a retaining portion 310 including a plurality of resilient clip members 312 at the opposite side of the planar portion 214 from the elongated members 210*a,b*. These clips 312 extend initially at an angle (e.g., roughly a 135° angle) from the planar portion 214 before curling inward, defining a retaining area 314 between the clips in a direction parallel to the elongated axis of the post clip 302 and to the post to which it will be secured.

Figure 19A:
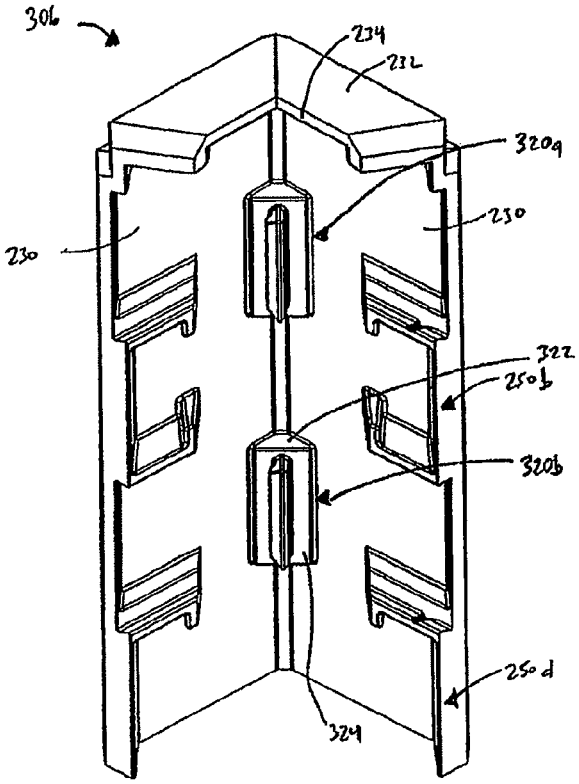
FIG. 19A is perspective view of a corner component from the device of FIG. 17.
Figure 19B:
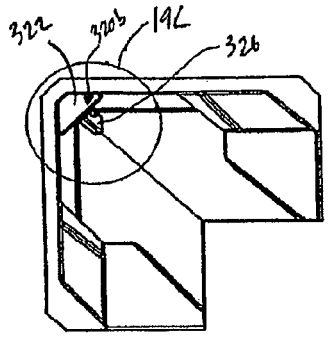
FIG. 19B is a bottom view of the corner component of FIG. 19A.
Figure 19C:
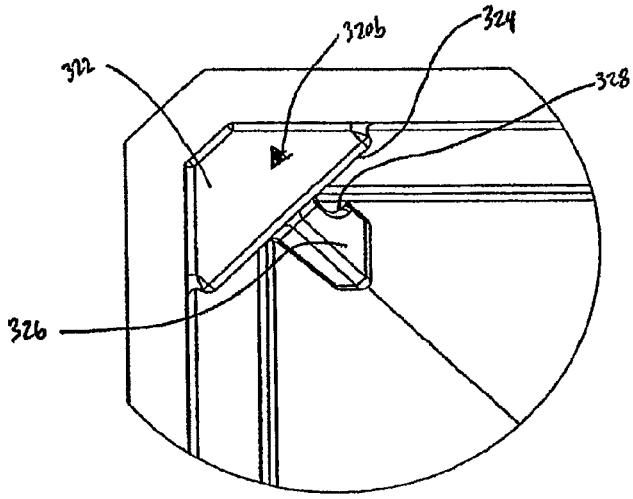
FIG. 19C is a detailed section of FIG. 19B.

FIGS. 19A-19C depict an embodiment of a corner component 306 suitable for use with the post cleat 302. The corner component 306 has many similar features to the corner component 206 of FIGS. 15A-15D. In particular, the corner component 306 includes vertical interior faces 230, sloped upper portion 232, and glide structures 250*a,b,c,d*, substantially as described with respect to FIGS. 15A-15D. However, the corner component 306 comprises two anchor features 320*a,b* positioned between vertical interior faces 230. Anchor feature 320*b* may be spaced apart from the base 321 of the corner component 306 by a distance, and anchor feature 320*a* may be located in line with and spaced apart from the anchor feature 320*a* by a distance. The anchor features 320*a,b* include a foundation portion 322 secured to each of the vertical interior faces 230, which may have, e.g., a trapezoidal or triangular cross-section depending on the shape of the juncture between the interior faces 230. Extending inward from an exposed inner face 324 of the foundation portion 322 is an elongated connecting member 326 which extends almost the height of the inner face 324 along an axis oriented substantially parallel to the inner face 324.

As can best be seen in FIG. 19C, the elongated connecting member 326 is narrow near the face 324 of the foundation portion but widens away from the face 324, providing a lip 328 to accept the curved ends of the clips 312 of the post cleat 302 and retain the corner component 306 relative to the post cleat 302. The elongated connecting member 326 again narrows near the end away from the face 324, providing a narrower end which will assist in deforming the clips 312 apart from one another and permit the entry of the elongated connecting member 326 into a retaining area 314 defined by the clips 213 of the post cleat 306 when the corner member 306 is pushed toward the post cleat 302.

Assembly of the post wrap system may proceed substantially as discussed with respect to the post wrap system 200 of FIG. 13, with the components being assembled over the post cleats 302 and then slid down so that the elongated connecting members 326 slide into the respective retaining areas 314 defined by the clips 312 on the post cleats 302. Alternately, the components may be assembled at the same level as the post cleats 302 (e.g., on the ground or other flat surface at the base of the post) so that they are interconnected but not yet brought into contact with the post sides. The corner components 306 may then be moved toward the post cleats 302 while the components are brought together, such that the elongated connecting member 326 pushes the clips 312 apart to permit entry into the retaining area 314. Once the corner components 306 abut the post and the elongated connecting member 326 is retained within the retaining area 314, the clips 312 can return to their non-deformed state and retain the lip 328 of the elongated connecting member 326.

Figure 20:
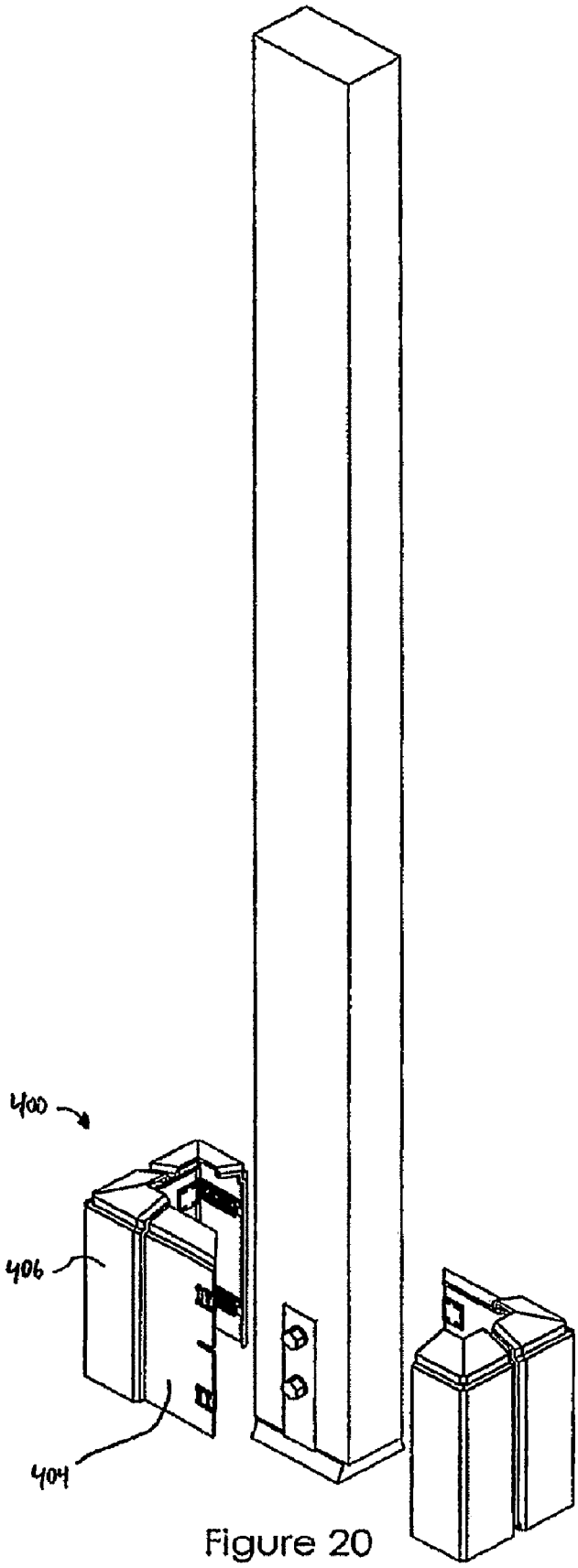
FIG. 20 is an exploded perspective view of an alternate embodiment of a post wrap device.

FIG. 20 depicts a partially assembled embodiment of a post wrap device 400. It can be seen that the post wrap device 400 does not include post cleat or other components to be fixedly coupled to the post (e.g., via a fastener such as a screw). Rather, the post wrap device 400 comprises only panel components 404 and corner components 406. Like certain embodiments discussed above, this facilitates the installation of such a device, as the device can be quickly assembled without the need for additional tools. In addition, installation of such a device does not involve the permanent alteration of the post, as would occur when components are fixedly coupled to the post via a fastener such as a screw.

Figure 21A:
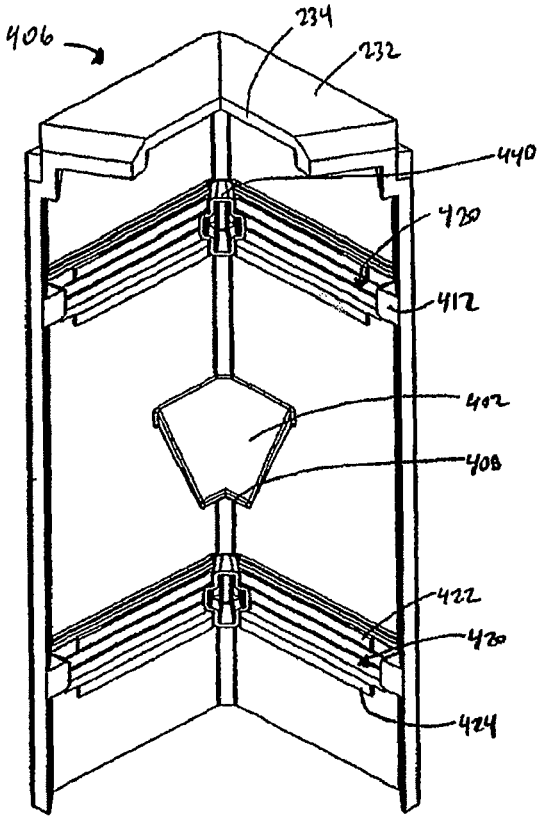
FIG. 21A is a perspective view of a corner component of the post wrap device of FIG. 20.
Figure 21B:
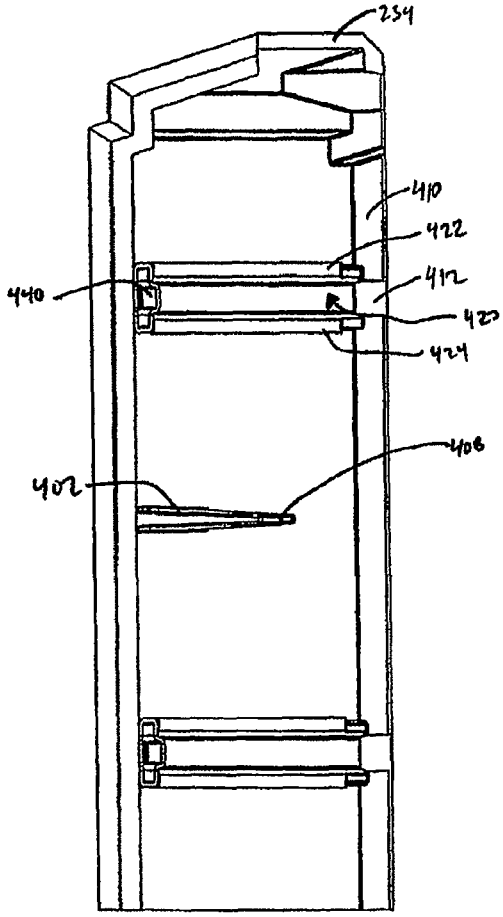
FIG. 21B is a side view of the corner component of FIG. 21A.
Figure 21C:
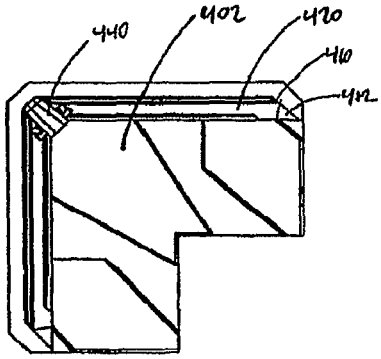
FIG. 21C is a bottom view of the corner component of FIG. 21A.
Figure 22A:
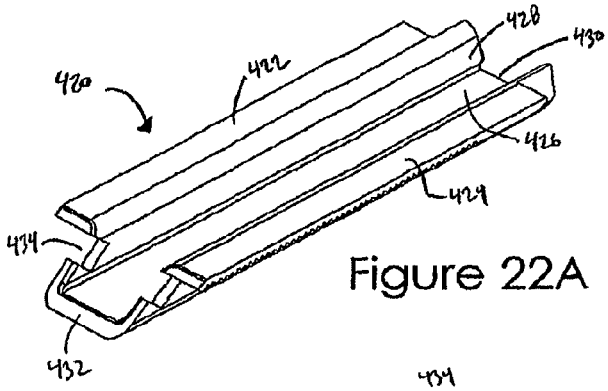
FIG. 22A is a perspective view of a slide component of the post wrap device of FIG. 20.
Figure 22B:
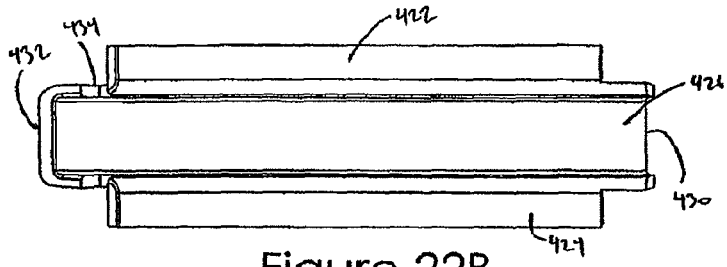
FIG. 22B is a view from above the slide component of FIG. 22A.
Figure 22C:
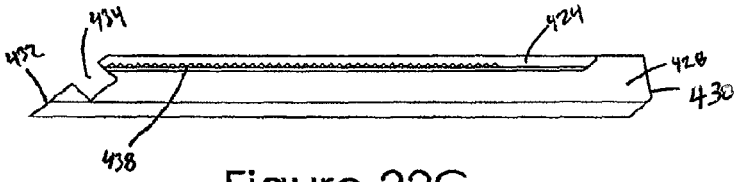
FIG. 22C is a side view of the slide component of FIG. 22A.
Figure 22D:
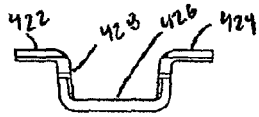
FIG. 22D is a front view of the slide component of FIG. 22A.
Figure 22E:
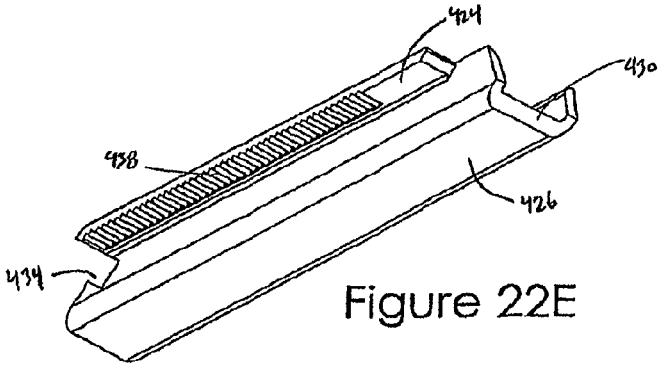
FIG. 22E is a perspective view from below the slide component of FIG. 22A.

FIGS. 21A-21C depict a corner component 406 of the post wrap device 400. The corner component 406 comprises interior vertical faces 230, as well as an upper section 232 having interior faces 234 configured to contact the face of the post. In addition, the post wrap device comprises a spacer member 402 consisting of a substantially planar member secured to and oriented orthogonally to each of the interior faces 230. The spacer member comprises a notch at the free end, the notch including interior faces 408 configured to contact the side of the post. As no components are directly attached to the post, the interior faces 408 maintain the orientation of the corner component 406 relative to the post in conjunction with interior faces 234. As best seen in FIGS. 21B and 21C, the corner component further comprises two elongated interior surfaces 410 located at each vertical edge of the corner component, the elongated interior surfaces 410 oriented at an inward facing (e.g., 135°) angle to the vertical interior faces 230. As can be best seen in FIG. 21C, extending from the interior surfaces 410 are a pair of stops 412 having a substantially triangular cross-section with the interior side oriented at an angle of less than 90° to the interior face 230 (e.g., at an smaller than 135° angle to the interior surface 410). This angle facilitates the use of these stops 412 to retain a component against the face 230.

The corner component 406 also comprises pairs of glide structures 420, with each slide structure 420 extending between a central connector 440 positioned at the juncture of the two vertical interior faces 230 and the stop 412 extending from the interior surface . As can be seen, the central connector 440 retains the interior end of each of a pair of slide structures 420. As will be discussed in greater detail below, the slide structures 410 comprise an upper flange 422 and a lower flange 424, each flange extending almost the length of the slide structures 420, but stopping short of the end of the slide structures 420 which abut the stop 412, such that a gap 414 exists between the edge of the flap and the edge of the interior surface 410, as can be most clearly seen in FIG. 21C.

FIGS. 22A-22E depict in detail a slide structure 420. As can be seen, the slide structures 420 comprise a substantially U-shaped main body having a substantially flat base 426 and substantially vertical walls 428. The upper and lower flanges 422,424 extend outward from the upper portions of the walls 428 in a direction parallel to the base 426. The glide structure includes a first end 430 having edges which taper slightly outward near the base 426, to match the angle of the interior surface of a stop 412. The edge of the base 426 also tapers slightly inward to match the angle of the interior surface 410, to ensure a snug fit against both surfaces. The second end 432 of the slide structure 420 tapers downward at a sharper angle and includes a notch 434, in order to fit snugly against the side of the central connector 440. As can best be seen in FIG. 22E, the flanges 422,424 also comprise notched sections 438 on the underside of the flanges, such that when the slide sections 420 are installed as shown in FIGS. 21A-C, the notched sections 438 will face the interior face 230 of the corner component 406.

Figure 23:
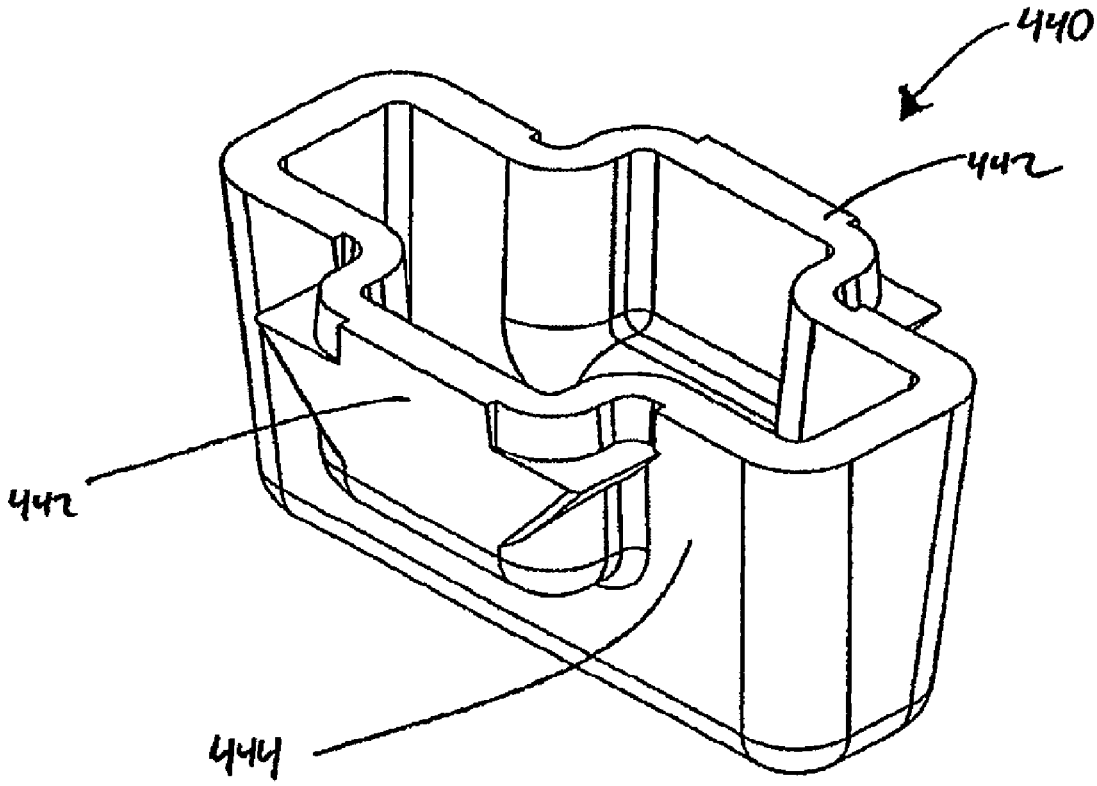
FIG. 23 is a perspective view of a central connector of the post wrap device of FIG. 20.

FIG. 23 depicts a central connector 440 for retaining the notched ends 432 of slide structures 420, as shown in FIG. 20A. It can be seen that the central connector 440 comprises a pair of extruding portions 442, one on either side, which are dimensioned to fit into the notches 434 in the slide structures 420. The non-notched portion of the edge 432 will fit against the side 444 of the central connector 440. Thus, it can be seen that each pair of slide structures can be held in place via a pair of stops 412 located opposite one another and a central connector 440 positioned at the juncture between the interior faces 230 of the corner connector 406.

FIGS. 24A-24D depict an intermediate panel 404 of the device 400. It can be seen that in contrast to some intermediate panels previously discussed, the intermediate panel 404 does not comprise rails or glides extending all the way across the front of the intermediate panel, but rather comprises a substantially planar vertical portion 450 and a sloped upper surface 452, which slopes inward at an angle which matches the sloped upper surface of the corner component 406. Attached to the planar portion are four retention structures 460, with the retention structures 460 arranged near the edges of the planar portion in pairs located at the same height at opposite edges of the planar portion 450. Between each of the pairs of retention structures are notches 454 extending horizontally inward.

Figure 24A:
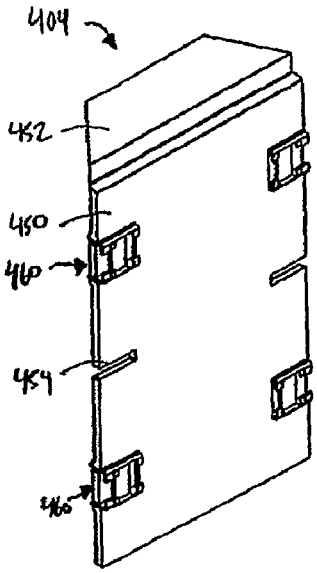
FIG. 24A is a perspective view of a panel component of the post wrap device of FIG. 20.
Figure 24B:
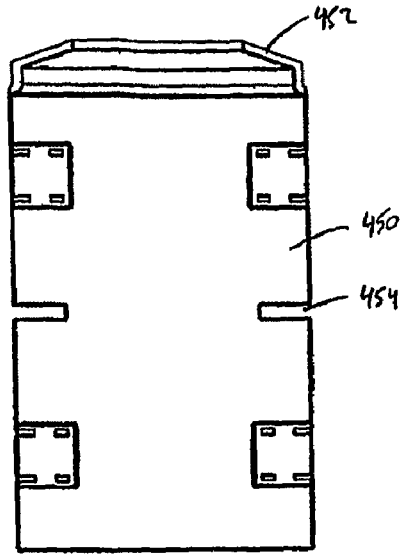
FIG. 24B is a rear view of the panel component of FIG. 24A.
Figure 24C:
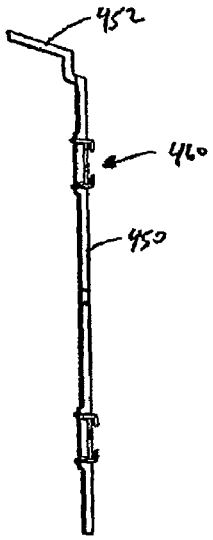
FIG. 24C is a side view of the panel component of FIG. 24A.
Figure 24D:
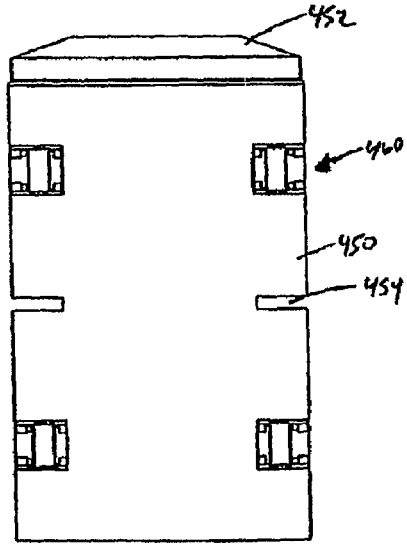
FIG. 24D is a front view of the panel component of FIG. 24A.
Figure 24E:
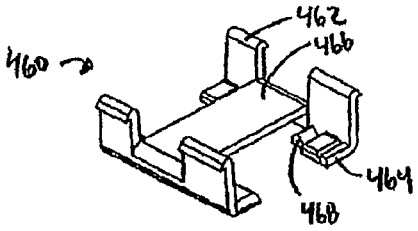
FIG. 24E is a perspective view of the retention component shown in FIG. 24A.
Figure 24F:
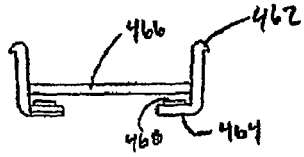
FIG. 24F is a side view of the retention component of FIG. 24E.

FIGS. 24E-24F depict in detail the retention structures 460. As can be seen, the retention structures 460 comprise four clips 462 which extend through slits in the planar portion 450 of the panel component 404 in order to fix the retention structure 460 to the panel component 404. On the opposite side of the clips 462 are four clips 464 configured to retain the flanges 422,424 of the slide structures 420 against a central panel 466. It can be seen that the thickness of the clips 464 decreases near the leading edges of the retention structure so as to facilitate reception of the flanges 422,424. In certain embodiments the apex of tooth formations 468 hinged on the trailing edge of the interior surface of the clips 464 may be closer to the central panel 466 than the thickness of the flanges 422,424, such that the teeth 468 must deform outward slightly to engage with the corresponding notched sections 438 in the flanges, increasing the retention force of the clips 464. Once engaged, this asymmetrically hinged tooth configuration prohibits retraction of the panel assembly 404 from the corner assembly 406 and inhibits or retards progression of the panel assembly 404 into the corner assembly 406.

Assembly of the post wrap device 400 may thus proceed as set forth below. The corner components 406 may advantageously be provided to the user with the slide structures 420 secured in place via stops 412 and central connectors 440, but in certain embodiments may be installed by the user. Similarly, the panel components 404 may advantageously be provided with the retention structures 460 in place, but in certain embodiments the retention structures 460 may be installed by the user. The retention features 460 are then aligned with the slide structures 420 and slid together such that the flanges 422,424 are retained by the clips 464 between the clips 464 and the central surface 466. The gap 414 facilitates the sliding of the flanges 422,424 into place. The components are then brought together so that they contact the post sides, and are held in place by the clip teeth 468 where they engage with the notched sections 458 on the flanges.

As can be seen, a variety of modifications may be made to each of the above embodiments and are contemplated within the scope of the invention. In addition, as noted above, the invention is not limited to protective devices to be applied at the bases of posts, although the embodiments discussed above have primarily been described with respect to that use. Rather, as noted above, various embodiments may be used to circumscribe the extremity of an upright, perpendicular, or interconnecting frame component or member.

The embodiments discussed above may be manufactured in a variety of ways, and from a wide variety of components. In various embodiments, certain components discussed above may comprise polymeric materials. In particular, components such as a spring member 56 or a sliding spring clamp 140 or 180 may be advantageously formed from a polymeric material, as polymeric materials provide desirable flexibility and resilience. In other embodiments, visible components of the post wrap apparatuses may be advantageously formed from a wood composite material, particularly a wood/polymer composite. Such a wood composite provides the aesthetic appeal and functionality of wood components, permitting the components to be easily painted, for example, and these materials also provide additional advantages, such as durability, due to their composite nature. Nevertheless, these components may be formed from other materials, as well.

It will also be understood that a variety of components described herein may be either combined or divided into subcomponents. For example, rather than securely coupling a corner component to a first panel component in many of the embodiments discussed herein, a combination embodiment comprising the corner component and a wing extension similar to a permanently attached panel component may be provided.

While the above detailed description has shown, described, and pointed out novel features of the invention as applied to various embodiments, it will be understood that various omissions, substitutions, and changes in the form and details of the device of process illustrated may be made by those skilled in the art without departing from the spirit of the invention. As will be recognized, the present invention may be embodied within a form that does not provide all of the features and benefits set forth herein, as some features may be used or practiced separately from others.

What is claimed is:

1. An apparatus for enclosing a portion of a member, comprising:

a plurality of corner components, each of said plurality of corner components configured to contact a different portion of the member, the corner components comprising:

at least one glide structure extending along a glide axis, the glide structure comprising a first glide surface extending substantially parallel to the at least one glide axis; and an inwardly extending projection, the inwardly extending projection comprising an abutment surface configured to contact a portion of said member;

a plurality of intermediate components, each of said intermediate components comprising at least one groove structure extending along a groove axis, the groove structure comprising a first groove surface extending substantially parallel to the groove axis, wherein the at least one groove structure is configured to slidably interconnect with glide structures on adjacent corner components; and a plurality of cleats configured to be secured to the retainer, wherein each of said plurality of cleats is configured to interact with a portion of one of said plurality of corner components to inhibit at least some motion of the corner component.

2. The apparatus of claim 1, wherein at least one of said glides comprises a notch, and wherein an intermediate component comprises a toggle configured to engage said notch.

3. The apparatus of claim 2, wherein the toggle extends at least partially into the space defined by the groove component on the at least one intermediate member.

4. The apparatus of claim 1, wherein said plurality of cleats comprise at least one fastener retainer configured to direct a fastener into a surface of the member.

5. The apparatus of claim 4, wherein the fastener is not orthogonal to said surface of the member.

6. The apparatus of claim 1, wherein said cleats comprise a glide member, and wherein the corner components comprise guide rails configured to receive and retain said glide member.

7. The apparatus of claim 6, wherein the guide rails extend substantially parallel to a central axis of the member to be enclosed.

8. The apparatus of claim 1, wherein said cleats comprise a plurality of resilient hook members, and wherein said corner components comprise a connecting member configured to be retained by said hook members.

9. The apparatus of claim 1, wherein at least a portion of the apparatus comprises a polymeric material.

10. The apparatus of claim 1, wherein the at least a portion of the apparatus comprises a wood-polymer composite material.

11. An apparatus for enclosing a portion of a member, said apparatus comprising:

a plurality of corner components and a plurality of intermediate components cooperating to define a perimeter about the portion of the member, each of said intermediate components configured to slidably interconnect with two corner components, and wherein one of said intermediate components comprises a feature configured to engage a corresponding feature on a first corner component to inhibit translation of the intermediate component away from the first corner component without inhibiting translation of the intermediate component relative to a second corner component; and a post cleat configured to be secured to the member, wherein the post cleat comprises a feature configured to engage a corner component to inhibit motion of the corner component in a direction away from the member.

12. The apparatus of claim 1, wherein at least one of the plurality of intermediate components has a substantially constant thickness.

13. The apparatus of claim 1, wherein at least one of the plurality of intermediate components comprises a corrugated section which defines the at least one groove member.

14. The apparatus of claim 1, wherein the inwardly extending projection comprises a sloped upper portion of the corner component, and wherein the abutment surface comprises two faces oriented at an angle to one another, each of said two faces configured to contact a different surface of said member.

15. The apparatus of claim 11, wherein said intermediate components are configured to be translated with respect to said corner components to vary the size of the perimeter.

16. The apparatus of claim 11, wherein the corner components comprise at least one glide and the intermediate components comprise at least one groove, wherein said groove is configured to receive a glide of an adjacent corner component.

17. The apparatus of claim 16, wherein the glide extends along a glide axis substantially orthogonal to a central axis of the member.

18. The apparatus of claim 16, wherein the groove is configured to receive a glide of each of the first and second corner components.

19. The apparatus of claim 18, wherein the intermediate component comprises a resilient toggle extending at least partially into the groove on the intermediate component, and the glide member of the first corner component comprises a notch configured to receive the toggle and inhibit translation of the intermediate component relative to the first corner component.

20. The apparatus of claim 11, wherein the post cleat comprises a glide member extending in a direction substantially parallel to a central axis of the member, and the corner component comprises a channel configured to receive at least a portion of said glide member.

21. The apparatus of claim 20, wherein the corner component comprises at least one guide rail defining the channel.

22. An apparatus for enclosing a portion of a member, the apparatus comprising:

a plurality of corner components, wherein at least one of said corner components comprises:

a substantially vertically extending face; and an inwardly extending upper portion, wherein said inwardly extending upper portion is oriented at an angle to said vertically extending face and wherein said vertically extending face comprises an abutment surface configured to contact a portion of said member;

at least one post cleat configured to be secured to the member, wherein a portion of the post cleat is configured to be retained by at least one corner component to secure said abutment surface of said at least one corner component against a surface of the member; and a plurality of intermediate components configured to adjustably interconnect with said plurality of corner components to enclose a section of the member.

23. An apparatus for enclosing a portion of a member, the member extending along a central axis, the apparatus comprising:

a plurality of corner components, each of said corner components comprising:

two interior faces oriented at an angle to one another, and a glide structure extending inwardly from each of the two interior faces, the glide structure comprising an upper glide surface and a lower glide surface;

a plurality of intermediate components, each of said intermediate components comprising a groove configured to receive a glide structure from two adjacent corner components so as to enclose the portion of the member; and a post cleat configured to be secured to the member, wherein the post cleat comprises a feature configured to engage a corner component to inhibit motion of the corner component in a direction away from the member.

24. The apparatus of claim 23, wherein the upper glide surface comprises an upward taper.

25. The apparatus of claim 23, wherein the upper glide surface of one of the glides comprises a notch, and wherein an adjacent intermediate component comprises a toggle configured to engage the notch to inhibit translation of a corner component relative to the adjacent intermediate component.

26. The apparatus of claim 23, wherein said post cleat feature configured to engage a corner component comprises a glide portion and wherein at least one interior face of a corner component comprises a guide rail defining a channel extending substantially parallel to the central axis of the member and configured to receive said glide portion of said post cleat secured to the member.

27. An apparatus for enclosing a portion of a member, said apparatus comprising:

a plurality of corner components and a plurality of intermediate components cooperating to define a perimeter about the portion of the member, wherein the corner components comprise at least one glide and the intermediate components comprise at least one groove, wherein said groove is configured to receive a glide of two adjacent corner components, such that each of said intermediate components is configured to slidably interconnect with two corner components, and wherein the intermediate component comprises a resilient toggle extending at least partially into said groove on the intermediate component, and the glide member of a first of said two corner components comprises a notch configured to receive the toggle and inhibit translation of said intermediate component away from said first corner component without inhibiting translation of the intermediate component relative to a second of said two corner components.

* * * * *